US009613536B1

(12) United States Patent
Wolford et al.

(10) Patent No.: US 9,613,536 B1
(45) Date of Patent: Apr. 4, 2017

(54) DISTRIBUTED FLIGHT MANAGEMENT SYSTEM

(71) Applicants: Brian R. Wolford, Cedar Rapids, IA (US); Thomas L. Vogl, Cedar Rapids, IA (US); Stephanie D. Burns, Ely, IA (US); Steven C. Morling, Cedar Rapids, IA (US); Matthew M. Lorch, Cedar Rapids, IA (US)

(72) Inventors: Brian R. Wolford, Cedar Rapids, IA (US); Thomas L. Vogl, Cedar Rapids, IA (US); Stephanie D. Burns, Ely, IA (US); Steven C. Morling, Cedar Rapids, IA (US); Matthew M. Lorch, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 246 days.

(21) Appl. No.: 14/685,455

(22) Filed: Apr. 13, 2015

(51) Int. Cl.
*G08G 5/00* (2006.01)

(52) U.S. Cl.
CPC ..... *G08G 5/003* (2013.01); *G08G 5/0069* (2013.01); *G08G 5/0082* (2013.01)

(58) Field of Classification Search
CPC ..... G08G 5/003; G08G 5/0069; G08G 5/0082
See application file for complete search history.

(56) References Cited

U.S. PATENT DOCUMENTS 9,132,913 B1 * 9/2015 Shapiro ..... B64C 19/00
2012/0265372 A1 * 10/2012 Hedrick ..... H04L 67/36 701/3
2015/0279126 A1 * 10/2015 Schindler ..... G08G 5/0013 701/3

OTHER PUBLICATIONS

U.S. Appl. No. 14/038,406, filed Sep. 26, 2013, Geoffrey A. Shapiro.
U.S. Appl. No. 14/038,439, filed Sep. 26, 2013, Geoffrey A. Shapiro.

* cited by examiner

*Primary Examiner* — Richard Camby
(74) *Attorney, Agent, or Firm* — Angel N. Gerdzhikov; Donna P. Suchy; Daniel M. Barbieri

(57) ABSTRACT

A method for operating a distributed flight management system. The method includes operating a control station instance of the distributed flight management system. The method includes receiving flight management system data from a remotely accessed vehicle. The method includes receiving time-space-position information of the remotely accessed vehicle from the remotely accessed vehicle. The method includes updating the control station instance of the distributed flight management system based at least on the received flight management system data and the time-space-position information of the remotely accessed vehicle. The method includes outputting updated flight management system data for transmission to the remotely accessed vehicle to synchronize a remotely accessed vehicle instance of the distributed flight management system with the control station instance of the distributed flight management system.

20 Claims, 12 Drawing Sheets

DISTRIBUTED FLIGHT MANAGEMENT SYSTEM

CROSS-REFERENCE TO RELATED APPLICATIONS

The present application is related to U.S. patent application Ser. No. 14/038,406, filed on Sep. 26, 2013, and to U.S. patent application Ser. No. 14/038,439, filed on Sep. 26, 2013, both of which are hereby expressly incorporated herein in their entirety.

BACKGROUND

A flight management system (FMS) is a planning and management tool for mission planning. Aircraft flying in national airspace (NAS) are required to be implemented with a standardized and certified FMS to fly routes shared with other air traffic. Currently, unmanned aerial systems (UAS), sometimes referred to as unmanned aerial vehicles (UAV), do not include FMSs onboard and do not have access for flying in national airspace.

Synchronization of control data between airborne and ground-based systems presents several challenges, including data bandwidth issues, loss of data issues, and on-time delivery of data issues. On traditional bus-connected avionics systems, synchronization of control data is handled by utilizing high bandwidth, low latency communication over directly coupled data busses; however, high bandwidth, low latency communication is difficult in UAS systems. For example, in UAS systems, systems are physically separated by large distances, and high latency is typical. Additionally, bandwidth is shared among multiple users, and only limited bandwidth slots are available for each UAS. Many current systems allocate higher bandwidth for mission/payload applications (such as video surveillance) than for control data and use the same radio for both payload and control. When there are greater numbers of vehicles in the airspace two things may happen: 1) they may share the same frequencies or at least the same general allocation of frequencies, which can results in less frequency (and hence less bandwidth) per user, and 2) a segregation of mission/payload data and control data.

Additionally, current UAS and optionally piloted vehicle (OPV) systems suffer from lost data links between a ground control station and the UAS/OPV. Wireless links (as opposed to local, wired, databuses) can necessitate more information for the system to manage instances of lost link that are not found in local, wired applications. More information can require checks for availability of communications, protocols for reliable communications, and contingency management. Such communications links are bi-directional between the ground and air, and either or both links have the potential to be lost. For example, asymmetric lost data links may include ground lost links, air lost links, and ground and air lost links. For ground lost links, a ground control station is unable to send flight plan modifications to an OPV or UAS, but the ground control station is still able to receive position and flight plan modifications from the OPV or UAS. For air lost links, an OPV or UAS is not able to send flight plan modifications or time-space-position-information (TSPI) to a ground control station, but the UAS or OPV is still able to receive flight plan modifications from the ground control station. For ground and air lost links, both of the OPV/UAS and the ground control station are not able to communicate flight plan modifications or position information between each other.

SUMMARY

In one aspect, embodiments of the inventive concepts disclosed herein are directed to a distributed flight management system including a control station. The control station includes a communication system and at least one processor. The communication system of the control station is configured to transmit data to a remotely accessed vehicle and to receive data from the remotely accessed vehicle. The at least one processor of the control station is configured to operate a control station instance of the distributed flight management system. The at least one processor of the control station is configured to receive flight management system data from the remotely accessed vehicle. The at least one processor of the control station is configured to receive time-space-position information of the remotely accessed vehicle from the remotely accessed vehicle. The at least one processor of the control station is configured to update the control station instance of the distributed flight management system based at least on the received flight management system data and the time-space-position information of the remotely accessed vehicle. The at least one processor of the control station is configured to output updated flight management system data for transmission to the remotely accessed vehicle to synchronize a remotely accessed vehicle instance of the distributed flight management system with the control station instance of the distributed flight management system.

In another aspect, embodiments of the inventive concepts disclosed herein are directed to a method of operating a distributed flight management system. The method includes operating a control station instance of the distributed flight management system. The method includes receiving flight management system data from a remotely accessed vehicle. The method includes receiving time-space-position information of the remotely accessed vehicle from the remotely accessed vehicle. The method includes updating the control station instance of the distributed flight management system based at least on the received flight management system data and the time-space-position information of the remotely accessed vehicle. The method includes outputting updated flight management system data for transmission to the remotely accessed vehicle to synchronize a remotely accessed vehicle instance of the distributed flight management system with the control station instance of the distributed flight management system.

In a further aspect, embodiments of the inventive concepts disclosed herein are directed to a method of operating a distributed flight management system. The method includes operating a remotely accessed vehicle instance of the distributed flight management system. The method includes receiving flight management system data from a control station. The method includes updating the remotely accessed vehicle instance of the distributed flight management system based at least on the received flight management system data from the control station. The method includes outputting updated flight management system data and time-space-position information for transmission to the control station to synchronize the remotely accessed vehicle instance of the distributed flight management system with a control station instance of the distributed flight management system.

Additional embodiments are described in the application including the claims. It is to be understood that both the foregoing general description and the following detailed description are exemplary and explanatory only and are not restrictive. Other embodiments will become apparent.

BRIEF DESCRIPTION OF THE FIGURES

Other embodiments will become apparent by reference to the accompanying figures in which.

DETAILED DESCRIPTION

Figure 1A:
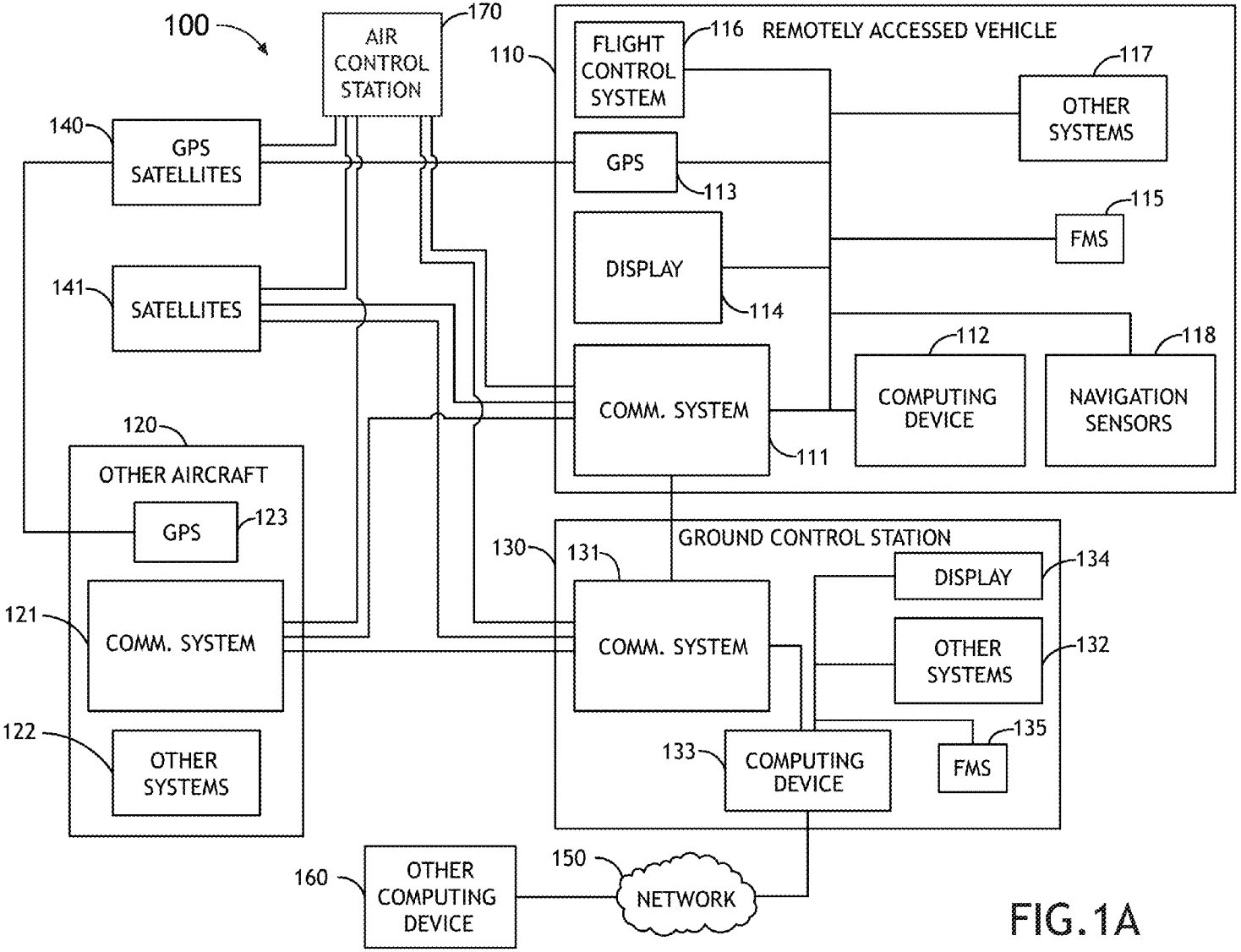
FIG. 1A shows a system topology of one embodiment.

Reference will now be made in detail to exemplary embodiments of the inventive concepts disclosed herein, which are illustrated in the accompanying drawings. The scope of the disclosure is limited only by the claims; numerous alternatives, modifications, and equivalents are encompassed. For the purpose of clarity, technical material that is known in the technical fields related to the embodiments has not been described in detail to avoid unnecessarily obscuring the description.

Some embodiments include a distributed FMS including an FMS of a ground control station communicatively coupled to an FMS of an optionally piloted vehicle (OPV). The distributed FMS may provide real-time flight management. Some embodiments include a distributed FMS including an instance of a FMS implemented at a ground control station (e.g., a mobile ground control station, an air traffic control station, or the like) and an instance of an FMS implemented in an optionally piloted vehicle (OPV), such as an unmanned aerial system (UAS). Some embodiments include synchronizing and/or prioritizing transmission of data between a ground control station based FMS and an aerial-based FMS to overcome or mitigate data bandwidth limitations, loss of data events, and lack of on-time delivery issues. Some embodiments include utilizing data link information (e.g., data link stability, data link status (e.g., link communicating or lost link), and data link strength) and mission context (e.g., approaches, take-off, search and rescue (SAR) patterns, cruise, etc.) to improve operations of synchronizing flight plan data of a ground-station-based FMS and an aerial-based FMS. Some embodiments are configured to synchronize commercial flight plan information, aircraft information, and autopilot commands between a ground control station based FMS and an aerial-based FMS.

In one embodiment, a remotely accessed vehicle instance of the distributed flight management system is fully synchronized with the control station instance of the distributed flight management system. In another embodiment, only a portion of the remotely accessed vehicle instance of the distributed flight management system is synchronized with the control station instance of the distributed flight management system. For example, there can be varying degrees of common or shared FMS functional computation between the remotely accessed vehicle instance of the distributed flight management system and the control station instance of the distributed flight management system to support different configurations, bandwidth availability, or the like. For example, one or more of navigation data (e.g., from a navigational database), flight performance data, flight leg data, waypoint sequencing data, flight plan data, telemetry data, data for graphical presentations (e.g., tables, maps, video, synthetic visual depictions, etc.) of various types of information, or the like may be synchronized between the remotely accessed vehicle instance of the distributed flight management system and the control station instance of the distributed flight management system. Further, the degree to which the remotely accessed vehicle instance of the distributed flight management system is synchronized with the control station instance of the distributed flight management system can be adjusted (e.g., automatically, user-adjusted, and/or dynamically adjusted) based on data link parameters, mission parameters, application requirements, system requirements, user preferences, or the like. In one embodiment, where there is full synchronization or substantially full synchronization between the remotely accessed vehicle instance of the distributed flight management system and the control station instance of the distributed flight management system, all or most FMS data may be exchanged between the remotely accessed vehicle instance of the distributed flight management system and the control station instance of the distributed flight management system with data checking (e.g., cyclic redundancy check calculations, or the like) at the control station and the remotely accessed vehicle. In another embodiment where only a portion of the remotely accessed vehicle instance of the distributed flight management system is synchronized with the control station instance of the distributed flight management system, a lesser (e.g., minimal) amount or only some types of FMS data may be exchanged between the remotely accessed vehicle instance of the distributed flight management system and the control station instance of the distributed flight management system with or without data checking (e.g., cyclic redundancy check calculations, or the like) at the control station and the remotely accessed vehicle; that is, for example, some amount of or some types of FMS data may be reduced or may not be shared with the remotely accessed vehicle. Additionally, in one embodiment, the remotely accessed vehicle may be implemented with or configured to utilize a reduced (e.g., minimal) functionality remotely accessed vehicle instance of the distributed flight management system, whereby some of the FMS computations are not performed at the remotely accessed vehicle, but rather at the control station. Such an embodiment with a reduced functionality remotely accessed vehicle instance of the distributed flight management system may reduce the necessary computational processing to be performed at the remotely accessed vehicle and allow for interoperability with third-party systems while still meeting airborne certification functionality requirements.

Embodiments including an FMS on an unmanned system can enable greater access to airspace. An FMS on an unmanned system can include portions of the functions that are run on the air vehicle and on the ground and that communicate with each other, for example, by radio. Embodiments that include an FMS in an unmanned system is a change in conventional flight management systems that are run over local, wired data busses with greater bandwidth, reliability and latency response times. Moving the communication link from an onboard wired link to a wireless link creates additional considerations. For example, if the wireless link has less data bandwidth available, embodiments include the utilization of communications protocols that are improved or optimized (such as with new protocols or (while maintaining the certification basis of existing applications) with compression of existing protocols). Additionally, for example, if the wireless link has additional latency or less deterministic latency, the system still needs to function properly (potentially with more outer loop control elements within the FMS). Further, for example, reliability of the wireless link is lower than a wired data bus, and some embodiments include procedures for ensuring that the system's required performance is met. Embodiments include a system that reduces bandwidth, maintains reliability of the link, and functions even with increased system latency, and embodiments do this while maintaining the certification basis of existing systems.

Some embodiments include Remotely Piloted Aircraft Systems (RPAS), which are vehicles that can be controlled by a remote operator and do not require a person onboard. Some embodiments include a system including a vehicle and the ground control station. A remotely piloted vehicle may be the airborne portion of the system. The ground control station may be a ground-based portion of the system and the portion with direct user interfaces. RPASs include unmanned vehicles and optionally manned vehicles. Optionally manned vehicles are those that can fly with a pilot onboard or can be operated remotely without a pilot onboard. An optionally piloted vehicle with a pilot onboard may also be supported by techniques disclosed throughout. A remotely accessed vehicle may be implemented as a remotely piloted or optionally piloted vehicle. An optionally piloted vehicle may include control-of-system options including where command decisions for the operation of the vehicle originate.

In some embodiments, configurations can include full FMS functionality available from the airborne segment (such as in optionally piloted systems) or lesser (e.g., minimal) functionality in the airborne segment with functionality made available to the airborne segment via a wireless link. Embodiments provide a flexible method of managing competing needs of data, payload capacity, and mission requirements for air and ground systems.

Figure 1B:
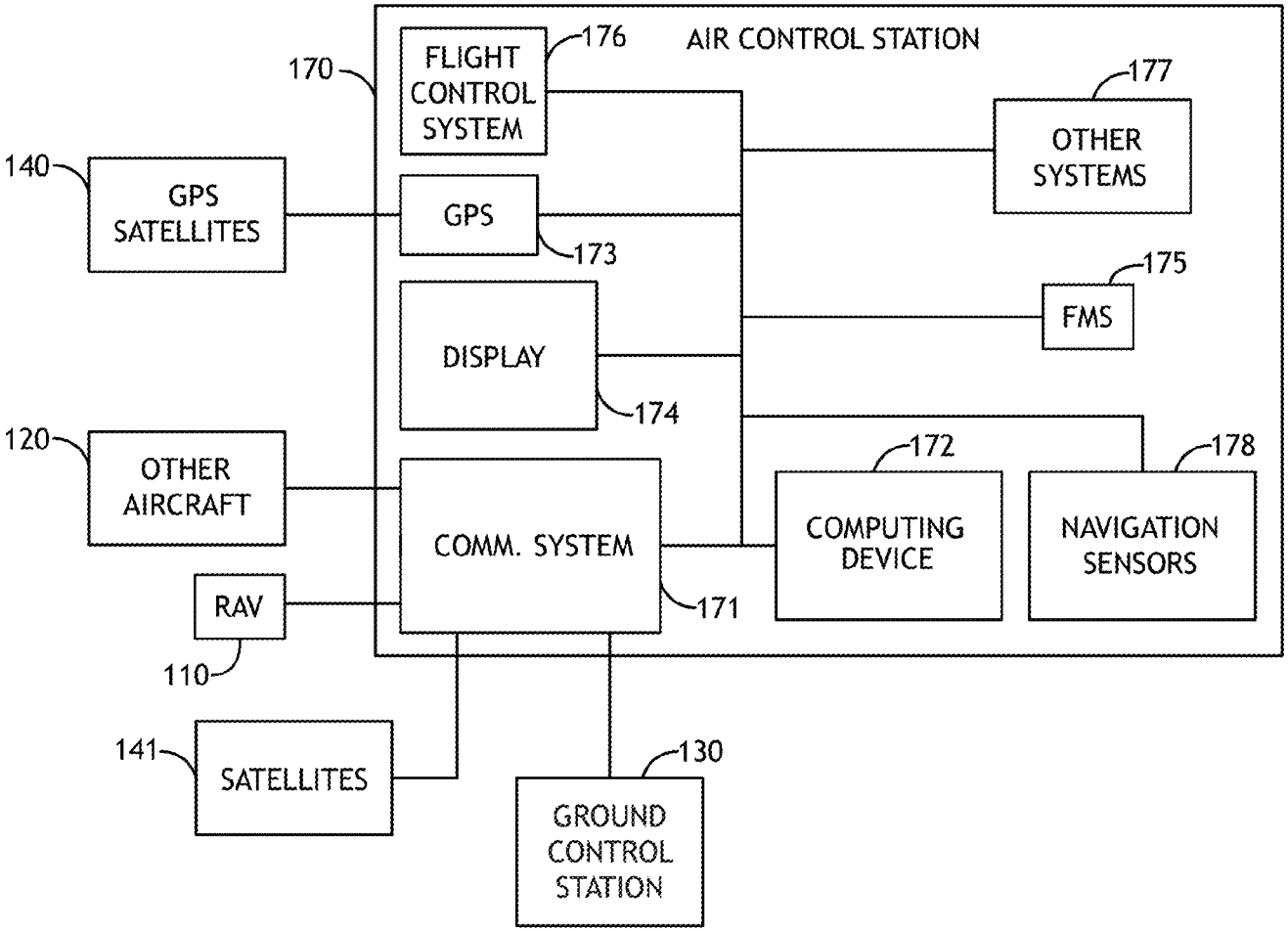
FIG. 1B shows a view of the system topology of FIG. 1.

Referring now to FIGS. 1A-B, an overall system diagram of one embodiment is depicted. The system 100 includes a remotely accessed vehicle (RAV) 110, a ground control station 130, other aircraft 120, global positioning system (GPS) satellites 140, satellites 141, a network 150, other computing device 160, and an air control station 170.

The RAV 110 includes a communication system 111, a computing device 112, a global positioning system (GPS) device 113, at least one (e.g., one, two, or more) display 114, a flight management system (FMS) 115, a flight control system 116, navigation sensors 118, other systems 117, equipment, and devices commonly included in aircraft. Some or all of the communication system 111, the computing device 112, the GPS device 113, the display 114, the FMS 115, the flight control system 116, the navigation sensors 118, and/or the other systems 117 are communicatively coupled. The RAV 110 may be implemented as an aircraft configured to accommodate one or more pilots; where the RAV 110 is configured to accommodate one or more pilots, the RAV 110 may be operated in part or whole by the ground control station 130 and automated or semi-automated processes executed by one or more processors of the RAV 110. In other embodiments, the RAV 110 may be implemented as an unmanned aerial system (UAS), such as an unmanned aerial vehicle (UAV) or a drone aircraft.

The communication system 111 is configured to send and/or receive signals, data, and/or voice transmissions to and/or from other aircraft 120, the ground control station 130, satellites 141, the air control station 170, or combinations thereof. That is, the communication system 111 is configured to exchange (e.g., bi-directionally exchange) signals, data, and/or voice communications with the other aircraft 120, the ground control station 130, the satellites 141, the air control station 170, or combinations thereof. For example, the communication system 111 may be configured for sending and receiving FMS flight plan data, aircraft information, and autopilot commands between a device of the ground control station 130 (e.g., a ground-based FMS (e.g., FMS 135) or computing device 133) and a device of the RAV 110 (e.g., an aerial-based FMS (e.g., FMS 115) or computing device 112). Additionally, for example, the communication system 111 may be configured for sending and receiving FMS flight plan data, aircraft information, and autopilot commands between a device of the air control station 170 (e.g., an air-based FMS (e.g., FMS 175) or computing device 172) and a device of the RAV 110 (e.g., an aerial-based FMS (e.g., FMS 115) or computing device 112). Further, for example, the communication system 111 may include a transceiver and an antenna. An exemplary suitable transceiver may include a radiofrequency signal emitter and receiver; such exemplary transceiver may be configured to transmit or broadcast signals to other aircraft (e.g., the other aircraft 120), the ground control station 130, the air control station 170, or the like. In one embodiment, the transceiver may be implemented as a universal access transceiver (UAT) configured to send and receive automatic dependent surveillance-broadcast (ADS-B) signals. Additionally, in some embodiments, the communication system 111 includes a communication radio configured to send and receive voice communications to/from other aircraft 120, one or more control stations (e.g., ground control station 130, air control station 170, and/or the like), or combinations thereof. The communication system 111 may further include at least one processor configured to run various software applications or computer code stored in a non-transitory computer-readable medium and configured to execute various instructions or operations.

In one embodiment, the GPS device 113 receives location data from the GPS satellites 140 and may provide the location data to any of various equipment/systems of the RAV 110 (e.g., the communication system 111, the computing device 112, the display 114, the FMS 115, the navigation sensors 118, the flight control system 116, and/or any of the other systems 117 of the RAV 110). For example, the GPS device 113 may receive or calculate location data from a sufficient number (e.g., at least four) of GPS satellites 140 in view of the RAV 110 such that a GPS solution may be calculated. In some embodiments, the GPS device is implemented as part of the navigation sensors 118.

In one embodiment, the display 114 may include projectors (such as an image projector, a retina projector, or the like), liquid crystal cells, and/or light emitting diodes (LEDs). The display 114 may be configured to present graphical content from the FMS 115 as a graphical user interface and link status information (e.g., information of whether a communication link is connected or lost with a particular control station (e.g., ground control station 130, air control station 170), link strength, or the like). Additionally, the display 114 may include or be implemented as a weather display overlay, a head-up display (HUD), a head-down display, a head-mounted display (HMD), an integrated display system, and/or the like. In some embodiments, the display 114 includes or is implemented as a touchscreen display. In some embodiments, the display 114 includes one or more components of a flight control panel. In some embodiments, for example, where the RAV 110 is implemented as a UAS, the RAV 110 does not include a display 114.

In one embodiment, the flight control system 116 is interfaceable by a pilot or is configured to receive instructions from an automated or semi-automated system (e.g., such as the flight management system 115) to control the aircraft's flight trajectory, flight speed, etc. In some embodiments, where the RAV 110 is implemented as a UAS, the RAV 110 does not include a flight control system 116 or does not include a flight control system 116 that is interfaceable by an on-board pilot.

In one embodiment, the navigation sensors 118 include sensors configured to sense any of various flight conditions or aircraft conditions typically used by aircraft. For example, various flight conditions or aircraft conditions may include altitude, position, speed, pitch, roll, yaw, air temperature, pressure, and/or the like. For example, the navigation sensors 118 may include a radio altimeter, the GPS device 113, airspeed sensors, flight dynamics sensors (e.g., configured to sense pitch, roll, and/or yaw), air temperature sensors, air pressure sensors, or the like. The navigation sensors 118 may be configured to sense various flight conditions or aircraft conditions and output data (e.g., flight condition data or aircraft condition data) to another device or system (e.g., computing device 112, the FMS 115, or the communication system 111) of the RAV 110 or of the overall system 100.

In one embodiment, the other systems 117 of the RAV 110 include a weather radar system, an auto-flight system, an autopilot system, a traffic collision avoidance system (TCAS), and/or the like.

In one embodiment, the other aircraft 120 includes a communication system 121, a GPS device 123, as well as other systems 122, equipment, and devices commonly included in aircraft, as similarly described with reference to the RAV 110 above. The other aircraft 120 may be implemented as an RAV, such as a UAS or an OPV.

In one embodiment, the ground control station 130 includes a communication system 131, at least one computing device 133, at least one display 134, and an FMS 135, as well as other systems 132, equipment, and devices commonly included in a ground control station 130. Some or all of the communication system 131, the computing device 133, the display 134, the FMS 135, and the other systems 132 may be communicatively coupled. The ground control station 130 may be implemented as a fixed location ground control station (e.g., a ground control station of an air traffic control tower) or a mobile ground control station (e.g., a ground control station implemented on a non-airborne vehicle (e.g., an automobile or a ship) or a trailer). In one embodiment, the ground control station 130 includes a surrogate UAS platform configured for remote operation, lateral navigation, and control and non-payload communications (CNPC) connectivity integrated with avionics configured to reduce size, weight, power, and cost (SWaP-C). In one embodiment, the ground control station 130 is implemented as an adaptive flight display-hosted ground control station configured for required navigation performance (RNP) configured with standard navigation database access, airspace access, interfaces for one or more users or operators.

The communication system 131 may be configured to receive signals from and transmit signals to aircraft (e.g., the RAV 110, the air control station 170, the other aircraft 120), as well as the satellites 141. That is, for example, the communication system 131 may be configured to exchange (e.g., bi-directionally exchange) signals, data, and/or voice communications with the other aircraft 120, the RAV 110, the satellites 141, the air control station 170, or combinations thereof. For example, the communication system 131 may be configured for sending and receiving FMS flight plan data, aircraft information, and autopilot commands between a device of the ground control station 130 (e.g., a ground-based FMS (e.g., FMS 135) or computing device 133) and a device of the RAV 110 (e.g., an aerial-based FMS (e.g., FMS 115) or computing device 112). Further, for example, the communication system 131 may be configured for sending and receiving FMS flight plan data, aircraft information, and autopilot commands between a device of the ground control station 130 (e.g., a ground-based FMS (e.g., FMS 135) or computing device 133) and a device of the air control station 170 (e.g., an aerial-based FMS (e.g., FMS 175) or computing device 172). Additionally, for example, the communication system 131 may include a transceiver and an antenna. An exemplary suitable transceiver may include a radiofrequency signal emitter and receiver; such exemplary transceiver may be configured to transmit or broadcast signals to aircraft (e.g., the RAV 110, the air control station 170, the other aircraft 120). In one embodiment, the transceiver may be implemented as a universal access transceiver (UAT) configured to send and receive automatic dependent surveillance-broadcast (ADS-B) signals. Additionally, in some embodiments, the communication system 131 includes a communication radio configured to send and receive voice communications to/from the RAV 110, the air control station 170, and the other aircraft 120. The communication system 131 may further include at least one processor configured to run various software applications or computer code stored in a non-transitory computer-readable medium and configured to execute various instructions or operations.

In one embodiment, the computing device 133 may be communicatively coupled to an input device (e.g., mouse, keyboard, microphone, or the like), an output device (e.g., display 134, speaker, or the like), or an input/output device (e.g., a touchscreen display, or the like) configured to interface with a user. The computing device 133 may include at least one processor configured to run various software applications or computer code stored in a non-transitory computer-readable medium and configured to execute various instructions or operations. For example, the computing device 133 may be configured to output data to an output device for presentation to a user, and the computing device 133 may be further coupled to an input device configured to receive input data from a user. In one embodiment, some or all of a plurality of computing devices (e.g., 133) are communicatively coupled to each other. In further embodiments, one or more of the at least one computing device 133 is communicatively connected to at least one other computing device 160 via one or more networks 150 (e.g., internet, intranet, or the like). For example, the other computing device 160 may comprise a computing device at a different ground control station or a computing device including a computer-readable medium containing a navigation database. The computing device 133 is described in more detail with respect to FIGS. 2A-3C, below.

In one embodiment, the display 134 may include projectors (such as an image projector, a retina projector, or the like), liquid crystal cells, and/or light emitting diodes (LEDs). The display 134 may be configured to present graphical content from the FMS 135 as a graphical user interface and link status information (e.g., information of whether a communication link is connected or lost with the RAV 110 or the air control station 170, link strength, or the like) to a user. In some embodiments, the display 134 includes or is implemented as a touchscreen display configured to operate as an input/output device. In some embodiments, the display 134 is included as part of or implemented within the FMS 135, which is described in more detail with respect to FIGS. 2A-4, below. In some embodiments, the display 134 is implemented as an adaptive flight display (e.g., adaptive flight display 330 of FIG. 4). Some embodiments include a plurality of displays 134 configured to present various graphical content to one or more users. The display 134 may be configured to present video content to one or more users. The video content may include video content received from a camera or other sensor of the RAV 110 or the air control station 170 and/or video content generated by a synthetic visual system or combined synthetic visual system.

The air control station 170 includes a communication system 171, a computing device 172, a global positioning system (GPS) device 173, at least one display 174, a flight management system (FMS) 175, a flight control system 176, navigation sensors 178, other systems 177, equipment, and devices commonly included in aircraft. Some or all of the communication system 171, the computing device 172, the GPS device 173, the display 174, the FMS 175, the flight control system 176, the navigation sensors 178, and/or the other systems 177 are communicatively coupled. The air control station 170 may be implemented as an aircraft configured to accommodate one or more pilots; where the air control station 170 is configured to accommodate one or more pilots, the air control station 170 may be operated in part or whole by the ground control station 130 and automated or semi-automated processes executed by one or more processors of the air control station 170. In other embodiments, the air control station 170 may be implemented as an unmanned aerial system (UAS), such as an unmanned aerial vehicle (UAV) or a drone aircraft.

The air control station 170 may be an airborne control station. In some embodiments, the air control station is configured to tactically manage distributed flight management systems for a plurality (e.g., a squadron, a team, or the like) of manned and/or unmanned aircraft. For example, the air control station 170 may be implemented as an Airborne Warning and Control System (AWACS), such as a Boeing E-3 Sentry, configured to remotely operate multiple UAS systems. That is, for example, the air control station 170 may be configured to remotely operate a plurality of distributed flight managements systems, where each of the plurality of distributed flight managements systems is associated with operation of a particular manned or unmanned aircraft.

The communication system 171 is configured to send and/or receive signals, data, and/or voice transmissions to and/or from other aircraft 120, the RAV 110, the ground control station 130, satellites 141, another air control station, or combinations thereof. That is, the communication system 171 is configured to exchange (e.g., bi-directionally exchange) signals, data, and/or voice communications with the other aircraft 120, the RAV 110, the ground control station 130, the satellites 141, another air control station, or combinations thereof. For example, the communication system 171 may be configured for exchanging FMS flight plan data, aircraft information, and autopilot commands with a device of the ground control station 130 (e.g., a ground-based FMS (e.g., FMS 135) or computing device 133) and a device of the RAV 110 (e.g., an aerial-based FMS (e.g., FMS 115) or computing device 112). Further, for example, the communication system 171 may include a transceiver and an antenna. An exemplary suitable transceiver may include a radiofrequency signal emitter and receiver; such exemplary transceiver may be configured to transmit or broadcast signals to the other aircraft 120, the ground control station 130, the RAV 110, or the like. In one embodiment, the transceiver may be implemented as a universal access transceiver (UAT) configured to send and receive automatic dependent surveillance-broadcast (ADS-B) signals. Additionally, in some embodiments, the communication system 171 includes a communication radio configured to send and receive voice communications to/from the other aircraft 120, one or more control stations (e.g., ground control station 130, another air control station, and/or the like), or combinations thereof. The communication system 171 may further include at least one processor configured to run various software applications or computer code stored in a non-transitory computer-readable medium and configured to execute various instructions or operations.

In one embodiment, the GPS device 173 receives location data from the GPS satellites 140 and may provide the location data to any of various equipment/systems of the air control station 170 (e.g., the communication system 171, the computing device 172, the display 174, the FMS 175, the navigation sensors 178, the flight control system 176, and/or any of the other systems 177 of the air control station 170). For example, the GPS device 173 may receive or calculate location data from a sufficient number (e.g., at least four) of GPS satellites 140 in view of the air control station 170 such that a GPS solution may be calculated. In some embodiments, the GPS device 173 is implemented as part of the navigation sensors 118.

In one embodiment, the display 174 may include projectors (such as an image projector, a retina projector, or the like), liquid crystal cells, and/or light emitting diodes (LEDs). The display 174 may be configured to present graphical content from the FMS 175 as a graphical user interface and link status information (e.g., information of whether a communication link is connected or lost with a particular control station (e.g., ground control station 130, another air control station, the RAV 110, other aircraft 120, or the like), link strength, or the like). Additionally, the display 174 may include or be implemented as a weather display overlay, a head-up display (HUD), a head-down display, a head-mounted display (HMD), an integrated display system, and/or the like. In some embodiments, the display 174 includes or is implemented as a touchscreen display. In some embodiments, the display 174 includes one or more components of a flight control panel. In some embodiments, for example, where the air control station is implemented as a UAS, the air control station does not include a display 174.

In one embodiment, the flight control system 176 is interfaceable by a pilot or is configured to receive instructions from an automated or semi-automated system (e.g., such as the flight management system 175) to control the aircraft's flight trajectory, flight speed, etc. In some embodiments, where the air control station 170 is implemented as a UAS, the air control station 170 does not include a flight control system 176 or does not include a flight control system 176 that is interfaceable by an on-board pilot.

In one embodiment, the navigation sensors 178 include sensors configured to sense any of various flight conditions or aircraft conditions typically used by aircraft. For example, various flight conditions or aircraft conditions may include altitude, position, speed, pitch, roll, yaw, air temperature, pressure, and/or the like. For example, the navigation sensors 178 may include a radio altimeter, the GPS device 173, airspeed sensors, flight dynamics sensors (e.g., configured to sense pitch, roll, and/or yaw), air temperature sensors, air pressure sensors, or the like. The navigation sensors 178 may be configured to sense various flight conditions or aircraft conditions and output data (e.g., flight condition data or aircraft condition data) to another device or system (e.g., computing device 172, the FMS 175, or the communication system 171) of the air control station 170 or of the overall system 100.

In one embodiment, the other systems 177 of the air control station 170 include a weather radar system, an auto-flight system, an autopilot system, a traffic collision avoidance system (TCAS), and/or the like.

While the embodiment depicted in FIGS. 1A-B includes elements as shown, in some embodiments, one or more of the elements of the system 100 may be omitted, or the system 100 may include other elements. For example, one or more of the other aircraft 120, the global positioning system (GPS) satellites 140, satellites 141, the air control station 170, the network 150, or the other computing device 160 may be optional. Additionally, while an embodiment has been depicted as including two control stations (e.g., the air control station 170 and the ground control station 130), other embodiments may include any number (e.g., at least one) of control stations of various types positioned or moving anywhere in a system.

Figure 2A:
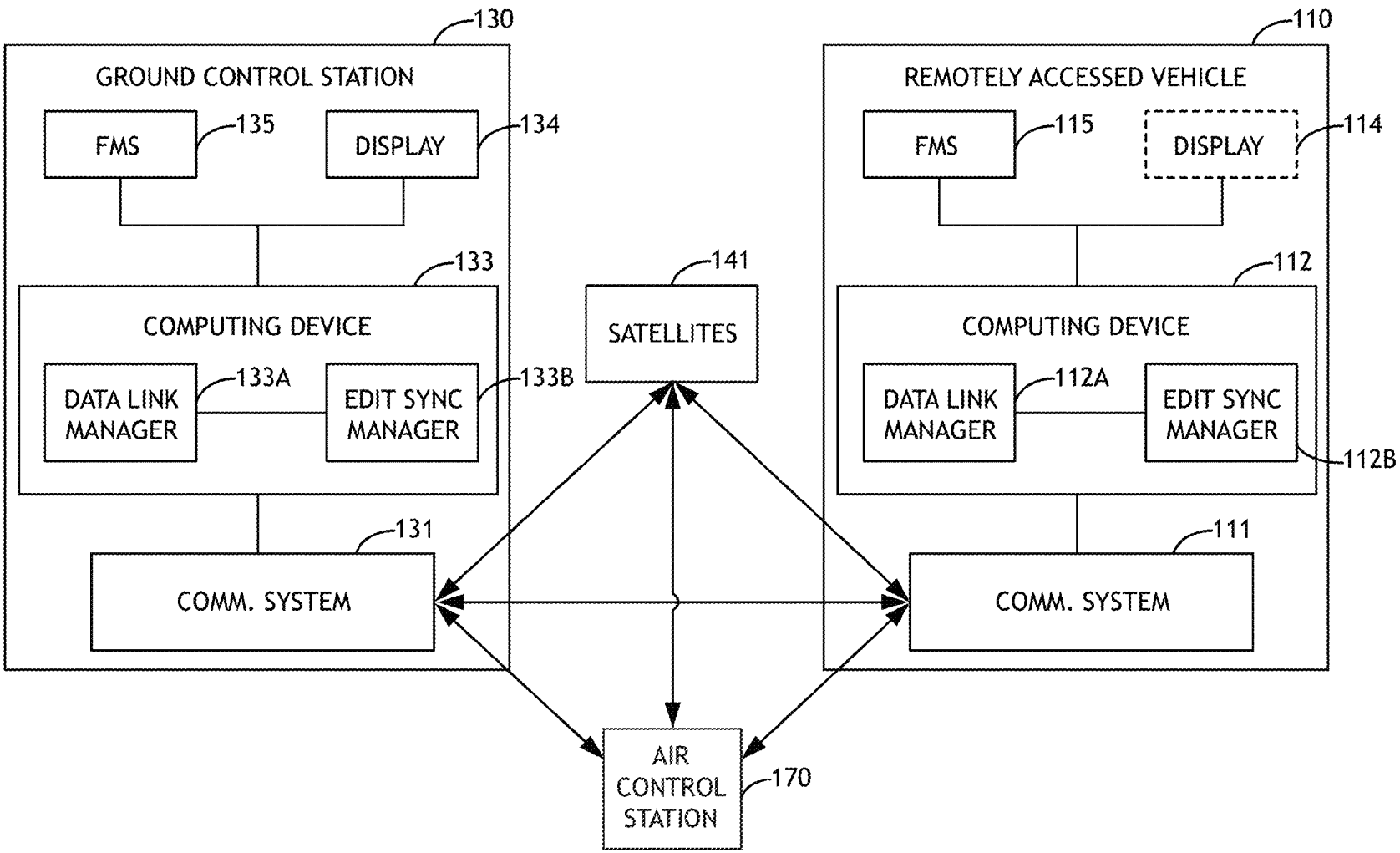
FIG. 2A depicts a system configured to communicate data, manage link connectivity, and manage synchronization between a flight management system of an ground control station and a flight management system of a remotely accessed vehicle of one embodiment.

Referring now to FIG. 2A, a system configured to communicate data, manage link connectivity, and manage synchronization between or among the FMS 135 of the ground control station 130, the FMS 175 of the air control station 170, and the FMS 115 of the RAV 110 of one embodiment is depicted. While FIG. 2 depicts a system configured to communicate data, manage link connectivity, and manage synchronization between or among the FMS 135 of the ground control station 130, the FMS 175 of the air control station 170, and the FMS 115 of the RAV 110, in other embodiments the system may be configured to communicate data, manage link connectivity, and manage synchronization between or among any suitable number (e.g., two or more) of FMSs located anywhere in the system.

In one embodiment, the FMS 135 of the ground control station 130, the FMS 175 of the air control station 170, and the FMS 115 of the RAV 110 operate as a distributed flight management system with one instance or node (i.e., the FMS 135) implemented and running at the ground control station 130, one instance or node (i.e., the FMS 175) implemented and running in the air control station 170, and one instance or node (i.e., the FMS 115) implemented and running in the RAV 110. The distributed FMS is configured to communicate and maintain substantial synchronization among the FMS 135 of the ground control station 130, the FMS 175 of the air control station 170, and the FMS 115 of the RAV 110 via one or more datalinks (e.g., at least one low latency data link, at least one relatively higher latency data link, or a combination thereof). For example, the one or more data links may include at least one data link between the communication system 131 of the ground control station 130 and the communication system 111 of the RAV 110, at least one data link between the communication system 131 of the ground control station 130 and the communication system 171 of the air control station 170, and/or at least one data link between the communication system 171 of the air control station 170 and the communication system 111 of the RAV 110. Additionally, the data links may be indirectly routed through the ground control station 130, satellites 141, the air control station 170, the RAV 110, the other aircraft 120, a combination thereof, or the like. While FIG. 2A depicts a distributed FMS including three FMSs (e.g., FMS 135, FMS, 115, and FMS 175), in other embodiments the distributed FMS may include any number (e.g., two or more) of FMSs. The distributed FMS is configured to communicate and maintain substantial synchronization among the FMS 135 of the ground control station 130, the FMS 175 of the air control station 170, and the FMS 115 of the RAV 110 via one or more datalinks (e.g., at least one low latency data link, at least one relatively higher latency data link, or a combination thereof).

Figure 2C:
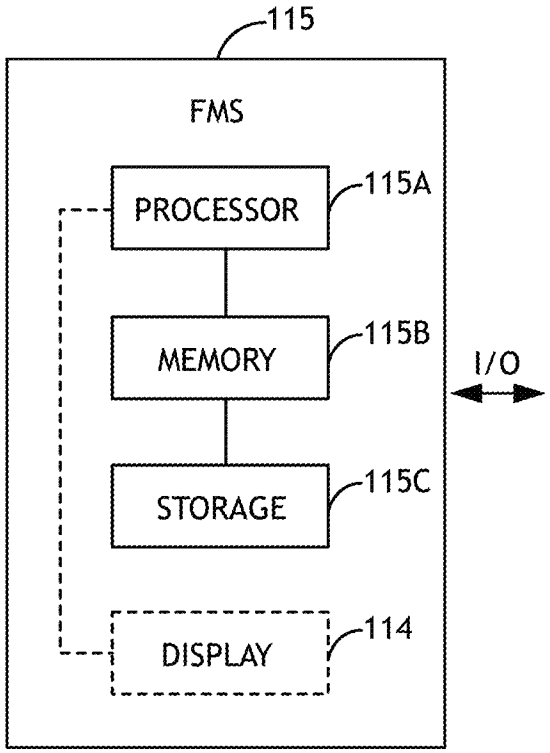
FIG. 2C depicts a flight management system of a remotely accessed vehicle of one embodiment.
Figure 2B:
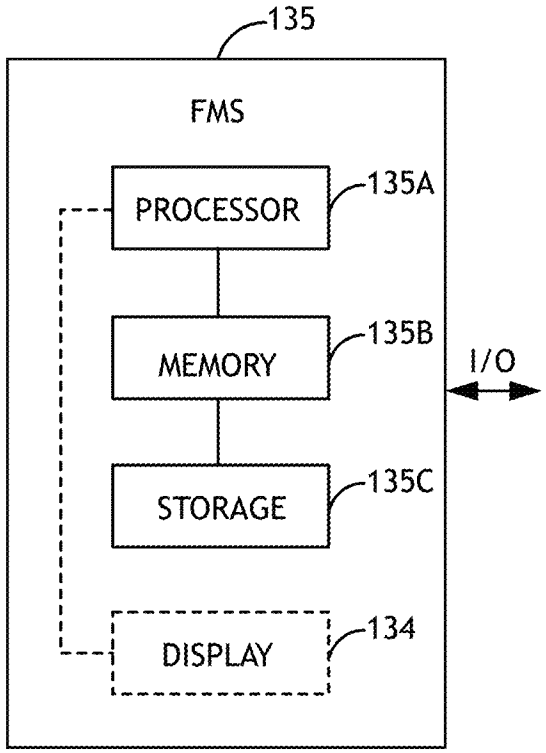
FIG. 2B depicts a flight management system of a ground control station of one embodiment.

Referring now to FIG. 2B, the FMS 135 of the ground control station 130 of one embodiment is shown. The FMS 135 includes at least one processor 135A, memory 135B, and storage 135C, as well as other components, equipment, and/or devices commonly included in a flight management system. The processor 135A, the memory 135B, and the storage 135C, as well as other components may be communicatively coupled. The processor 135A may be configured to run various software applications or computer code stored in a non-transitory computer-readable medium and configured to execute various instructions or operations.

In some embodiments, the FMS 135 of the ground control station 130 includes the display 134, which may be communicatively coupled to the processor 135A. In one embodiment, the FMS 135 of the ground control station 130 allows a user (e.g., an operator, a remote pilot, a remote co-pilot, or an air traffic controller) to: manage, view, monitor, and perform flight tasks (e.g., manual, semi-automated, or automated flight tasks) associated with the RAV 110; manage, view, monitor, and adjust flight plans associated with the RAV 110 or the air control station 170; manage, view, monitor, and adjust aircraft information of the RAV 110 or the air control station 170; manage, view, monitor, adjust, and send autopilot commands to the RAV 110 or the air control station 170; manage, view, monitor, prioritize, and adjust data link connectivity between or among the ground control station 130, the air control station 170, and/or the RAV 110; view graphical output of a synthetic vision system; view graphical output of a weather radar system; interface with controls (such as icon-based controls implemented on a touchscreen display); receive data from the FMS 115 of the RAV 110 or the FMS 175 of the air control station 170; synchronize data received from the FMS 115 and/or FMS 175 with data of the FMS 135; route data for transmission to the FMS 115 and/or FMS 175; and/or perform other flight management operations.

In one embodiment, the FMS 135 of the ground control station 130 is configured receive data (e.g., flight plan data, aircraft state data, command data, or the like) from the FMS 115 of the RAV 110 by way of data sent from the FMS 115 to the computing device 112, to the communication system 112, over a data link to the communication system 131, to the computing device 133, and to the FMS 135. The FMS 135 is configured to synchronize FMS data received from the FMS 115 with current data of the FMS 135. Additionally, the FMS 135 is configured to predict aircraft state data for use in predictive synchronization even when a data link between the ground control station 130 and the RAV 110 or air control station 170 is lost or partially lost. In one embodiment, the FMS 135 is configured to send data (e.g., FMS commands, autopilot commands, flight plan data, or the like) to the FMS 115 of the RAV 110 by way of sending data to the computing device 133, to the communication system 131, over a data link to the communication system 111, to the computing device 112, and to the FMS 115. Additionally, for example, data exchanged between or among the ground control station 130, the air control station 170, and/or the RAV 110 may be routed through one or a combination of the ground control station 130, the air control station 170, the RAV 110, the satellites 141, the other aircraft 120, and/or the network 150.

Referring now to FIG. 2C, the flight management system 115 of the RAV 110 of one embodiment is shown. The FMS 115 includes at least one processor 115A, memory 115B, and storage 115C, as well as other components, equipment, and/or devices commonly included in a flight management system. The processor 115A, the memory 115B, and the storage 115C, as well as other components may be communicatively coupled. The processor 115A may be configured to run various software applications or computer code stored in a non-transitory computer-readable medium and configured to execute various instructions or operations.

In embodiments where the RAV 110 includes a cockpit for an optional pilot, the FMS 115 of the RAV 110 may include the display 114, which may be communicatively coupled to the processor 115A. If, however, the RAV 110 is implemented as a UAS without a cockpit, the FMS 115 may not include the display 114. In one embodiment, the FMS 115 of the RAV 110 allows a pilot (e.g., an onboard pilot, an onboard co-pilot, or the like) to manage, view, monitor, and perform flight tasks (e.g., manual, semi-automated, or automated flight tasks) associated with the RAV 110. The FMS 115 of the RAV 110 may allow a pilot to manage, view, monitor, and adjust flight plans associated with the RAV 110. Additionally, the FMS 115 of the RAV 110 may allow a pilot to manage, view, monitor, and adjust aircraft information of the RAV 110. Also, the FMS 115 of the RAV 110 may allow a pilot to manage, view, monitor, adjust, and send autopilot commands to the RAV 110. Further, the FMS 115 of the RAV 110 may allow a pilot to manage, view, monitor, prioritize, and adjust data link connectivity between or among at least one control station (e.g., the ground control station 130 and/or the air control station 170) and the RAV 110. The FMS 115 of the RAV 110 may allow a pilot to view graphical output of a synthetic vision system or view graphical output of a weather radar system. The FMS 115 of the RAV 110 may allow a pilot to interface with controls (such as icon-based controls implemented on a touchscreen display). The FMS 115 of the RAV 110 may allow a pilot to be presented with information from the FMS 135 of the ground control station 130 and/or the FMS 175 of the air control station 170. The FMS 115 of the RAV 110 may allow a pilot to synchronize data received from the FMS 135 and/or the FMS 175 with data of the FMS 115. Further, the FMS 115 of the RAV 110 may allow a pilot to route data for transmission to the FMS 135 and/or the FMS 175. Also, the FMS 115 of the RAV 110 may allow a pilot to perform other flight management operations.

In embodiments where the RAV 110 is implemented as a UAS, the FMS 115 of the RAV 110 may be configured to manage, monitor, and perform flight tasks (e.g., semi-automated or automated flight tasks) associated with the RAV 110. Additionally, the FMS 115 of the RAV 110 may be configured to manage, monitor, and adjust flight plans associated with the RAV 110. Also, the FMS 115 of the RAV 110 may be configured to manage, monitor, and adjust aircraft information of the RAV 110. The FMS 115 of the RAV 110 may be configured to manage, monitor, and adjust autopilot commands for the RAV 110. Further, the FMS 115 of the RAV 110 may be configured to manage, monitor, prioritize, and adjust data link connectivity between or among the ground control station 130, the air control station 170, and/or the RAV 110. The FMS 115 of the RAV 110 may be configured to receive data from the FMS 135 of the ground control station 130 and/or the FMS 175 of the air control station 170 and synchronize data received from the FMS 135 and/or the FMS 175 with data of the FMS 115. The FMS 115 of the RAV 110 may be configured to route data for transmission to the FMS 135 and/or the FMS 175. The FMS 115 of the RAV 110 may be configured to perform other flight management operations. In one embodiment, the FMS 115 of the RAV 110 is configured to receive data from the FMS 135 of the ground control station 130 by way of data sent from the FMS 135 to the computing device 133, to the communication system 131, over a data link to the communication system 111, to the computing device 112, and to the FMS 115. Additionally, for example, data exchanged between or among the ground control station 130, the air control station 170, and/or the RAV 110 may be routed through one or a combination of the ground control station 130, the air control station 170, the RAV 110, the satellites 141, the other aircraft 120, and/or the network 150.

The FMS 115 is configured to synchronize FMS data received from the FMS 135 and/or the FMS 175 with current data of the FMS 115. In one embodiment, the FMS 115 is configured to send data to the FMS 135 of the ground control station 130 by way of sending data to the computing device 112, to the communication system 111, over a data link to the communication system 131, to the computing device 133, and to the FMS 135. Additionally, for example, the FMS 115 may be configured to send data to the FMS 175 of the air control station 170 by way of sending data to the computing device 112, to the communication system 111, over a data link to the communication system 171, to the computing device 172, and to the FMS 175.

Figure 2D:
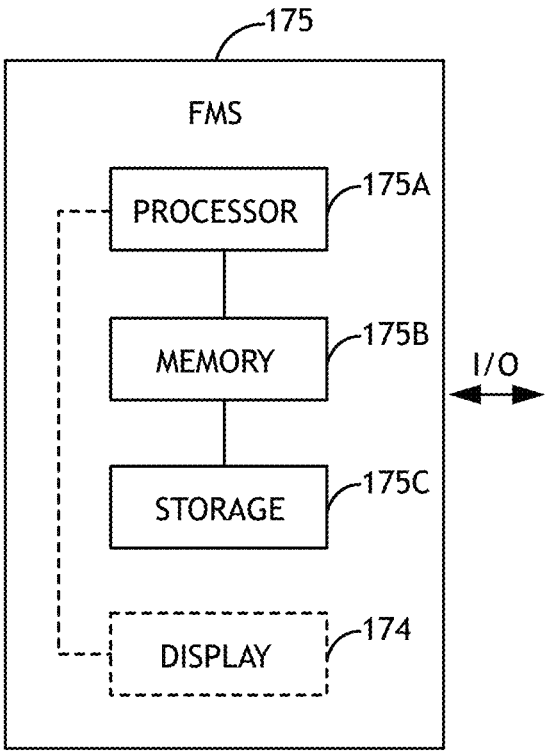
FIG. 2D depicts a flight management system of an air control station of one embodiment.

Referring now to FIG. 2D, the FMS 175 of the air control station 170 of one embodiment is shown. The FMS 175 includes at least one processor 175A, memory 175B, and storage 175C, as well as other components, equipment, and/or devices commonly included in a flight management system. The processor 175A, the memory 175B, and the storage 175C, as well as other components may be communicatively coupled. The processor 175A may be configured to run various software applications or computer code stored in a non-transitory computer-readable medium and configured to execute various instructions or operations.

In some embodiments, the FMS 175 of the air control station 170 includes the display 174, which may be communicatively coupled to the processor 175A. If, however, the air control station 170 is implemented as a UAS without a cockpit, the FMS 175 may not include the display 114. In one embodiment, the FMS 175 of the air control station 170 allows a user (e.g., an operator, a pilot, a remote pilot, or a remote co-pilot) to: manage, view, monitor, and perform flight tasks (e.g., manual, semi-automated, or automated flight tasks) associated with the RAV 110; manage, view, monitor, and adjust flight plans associated with the RAV 110 or the air control station 170; manage, view, monitor, and adjust aircraft information of the RAV 110 or the air control station 170; manage, view, monitor, adjust, and send autopilot commands to the RAV 110; manage, view, monitor, prioritize, and adjust data link connectivity between or among the ground control station 130, the air control station 170, other aircraft 110, and/or the RAV 110; view graphical output of a synthetic vision system; view graphical output of a weather radar system; interface with controls (such as icon-based controls implemented on a touchscreen display); receive data from the FMS 115 of the RAV 110 or the FMS 135 of the ground control station 130; synchronize data received from the FMS 115 and/or FMS 135 with data of the FMS 175; route data for transmission to the FMS 115 and/or FMS 135; and/or perform other flight management operations.

In one embodiment, the FMS 175 of the air control station 170 is configured to receive data (e.g., flight plan data, aircraft state data, command data, or the like) from the FMS 115 of the RAV 110 by way of data sent from the FMS 115 to the computing device 112, to the communication system 112, over a data link to the communication system 171, to the computing device 172, and to the FMS 175. The FMS 175 is configured to synchronize FMS data received from the FMS 115 and/or the FMS 135 with current data of the FMS 175. Additionally, the FMS 175 is configured to predict aircraft state data for use in predictive synchronization even when a data link between the air control station 170 and the RAV 110 or ground control station 130 is lost or partially lost. In one embodiment, the FMS 175 is configured to send data (e.g., FMS commands, autopilot commands, flight plan data, or the like) to the FMS 115 of the RAV 110 by way of sending data to the computing device 172, to the communication system 171, over a data link to the communication system 111, to the computing device 112, and to the FMS 115. Additionally, for example, data exchanged between or among the ground control station 130, the air control station 170, and/or the RAV 110 may be routed through one or a combination of the ground control station 130, the air control station 170, the RAV 110, the satellites 141, the other aircraft 120, and/or the network 150.

In one embodiment, where the air control station 170 includes a pilot, the FMS 175 of the air control station 170 allows a pilot (e.g., an onboard pilot, an onboard co-pilot, or the like) to manage, view, monitor, and perform flight tasks (e.g., manual, semi-automated, or automated flight tasks) associated with the air control station 170. The FMS 175 of the air control station 170 may allow a pilot to manage, view, monitor, and adjust flight plans associated with the air control station 170. Additionally, the FMS 175 of the air control station 170 may allow a pilot to manage, view, monitor, and adjust aircraft information of the air control station 170. Also, the FMS 175 of the air control station 170 may allow a pilot to manage, view, monitor, adjust, and send autopilot commands to the air control station 170. Further, the FMS 175 of the air control station 170 may allow a pilot to manage, view, monitor, prioritize, and adjust data link connectivity between or among at least one control station (e.g., the ground control station 130 and/or the air control station 170) and the air control station 170. The FMS 175 of the air control station 170 may allow a pilot to view graphical output of a synthetic vision system or view graphical output of a weather radar system. The FMS 175 of the air control station 170 may allow a pilot to interface with controls (such as icon-based controls implemented on a touchscreen display). The FMS 175 of the air control station 170 may allow a pilot to be presented with information from the FMS 135 of the ground control station 130 and/or the FMS 115 of the RAV 110. The FMS 175 of the air control station 170 may allow a pilot to synchronize data received from the FMS 135 and/or the FMS 115 with data of the FMS 175. Further, the FMS 175 of the air control station 170 may allow a pilot to route data for transmission to the FMS 135 and/or the FMS 115. Also, the FMS 175 of the air control station 170 may allow a pilot to perform other flight management operations.

In embodiments where the air control station 170 is implemented as a UAS, the FMS 175 of the air control station 170 may be configured to manage, monitor, and perform flight tasks (e.g., semi-automated or automated flight tasks) associated with the air control station 170. Additionally, the FMS 175 of the air control station 170 may be configured to manage, monitor, and adjust flight plans associated with the air control station 170. Also, the FMS 175 of the air control station 170 may be configured to manage, monitor, and adjust aircraft information of the air control station 170. The FMS 175 of the air control station 170 may be configured to manage, monitor, and adjust autopilot commands for the air control station 170. Further, the FMS 175 of the air control station 170 may be configured to manage, monitor, prioritize, and adjust data link connectivity between or among the ground control station 130, the air control station 170, and/or the RAV 110. The FMS 175 of the air control station 170 may be configured to receive data from the FMS 135 of the ground control station 130 and/or the FMS 115 of the RAV 110 and synchronize data received from the FMS 135 and/or the FMS 115 with data of the FMS 175. The FMS 175 of the air control station 170 may be configured to route data for transmission to the FMS 135 and/or the FMS 115. The FMS 175 of the air control station 170 may be configured to perform other flight management operations. In one embodiment, the FMS 175 of the air control station 170 is configured to receive data from the FMS 135 of the ground control station 130 by way of data sent from the FMS 135 to the computing device 133, to the communication system 131, over a data link to the communication system 171, to the computing device 172, and to the FMS 175. Additionally, for example, data exchanged between or among the ground control station 130, the air control station 170, and/or the RAV 110 may be routed through one or a combination of the ground control station 130, the air control station 170, the RAV 110, the satellites 141, the other aircraft 120, and/or the network 150.

The FMS 175 is configured to synchronize FMS data received from the FMS 135 and/or the FMS 115 with current data of the FMS 175. In one embodiment, the FMS 175 is configured to send data to the FMS 135 of the ground control station 130 by way of sending data to the computing device 172, to the communication system 171, over a data link to the communication system 131, to the computing device 133, and to the FMS 135. Additionally, for example, the FMS 115 may be configured to send data to the FMS 115 of the RAV 110 by way of sending data to the computing device 172, to the communication system 171, over a data link to the communication system 111, to the computing device 112, and to the FMS 115.

Figure 3B:
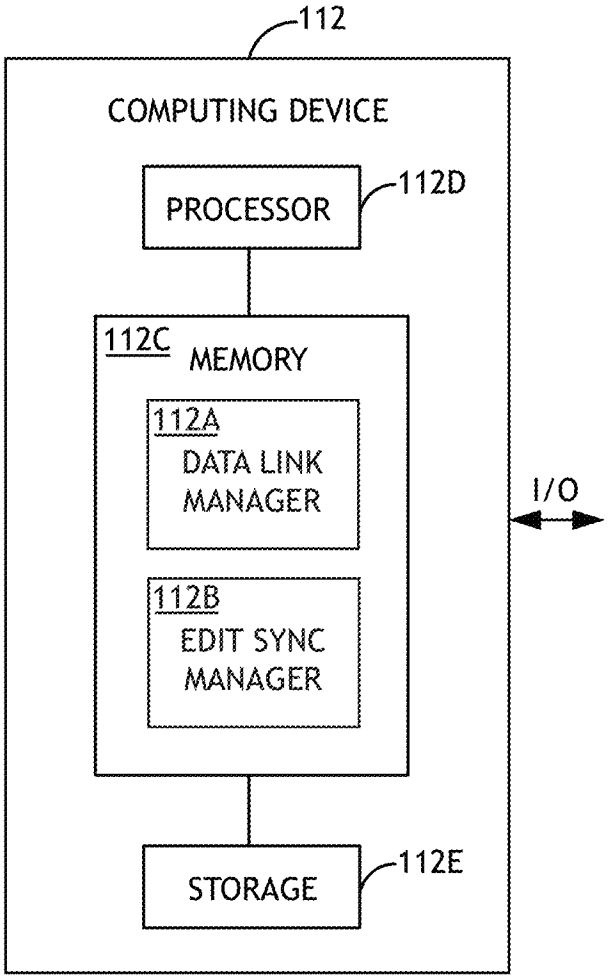
FIG. 3B depicts a computing device of a remotely accessed vehicle of one embodiment.
Figure 3A:
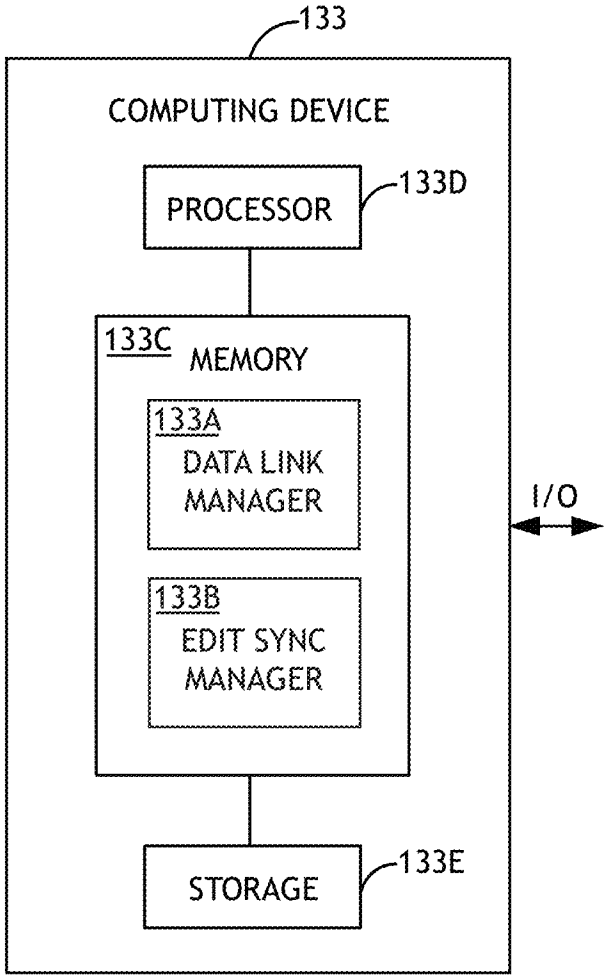
FIG. 3A depicts a computing device of a ground control station of one embodiment.

Referring now to FIG. 3A, the computing device 133 of the ground control station 130 of one embodiment is shown. The computing device 133 includes at least one processor 133D, memory 133C, and storage 133E, as well as other components, equipment, and/or devices commonly included in a computing device. The processor 133D, the memory 133C, and the storage 133E, as well as any other components may be communicatively coupled. The processor 133D may be configured to execute various software applications, instructions, or computer code stored in a non-transitory computer-readable medium (e.g., the memory 133C or the storage 133E) causing the processor 133D to perform various operations. For example, a data link manager 133A may be stored as software, computer code, or instructions in the memory 133C and/or the storage 133E, and an edit synchronization manager 133B may be stored as software, computer code, or instructions in the memory 133C and/or the storage 133E. For example, execution of the data link manager 133A software by the processor 133D causes the processor to perform various data link management operations or to output instructions or signals to another device or component (such as the FMS 135, the display 134, or the communication system 131). For example, execution of the edit synchronization manager 133B software by the processor 133D causes the processor 133D to perform various synchronization operations or to output instructions or signals to another device or component (such as the FMS 135 or the display 134). While FIG. 3A shows the data link manager 133A and the edit synchronization manager 133B stored in memory 133C, any of various suitable software applications, programs, or computer code may be stored in a non-transitory computer-readable medium configured to be executed by the processor 133D for performing any of various operations or functions as disclosed throughout.

Referring now to FIG. 3B, the computing device 112 of the RAV 110 of one embodiment is shown. The computing device 112 includes at least one processor 112D, memory 112C, and storage 112E, as well as other components, equipment, and/or devices commonly included in a computing device. The processor 112D, the memory 112C, and the storage 112E, as well as any other components may be communicatively coupled. The processor 112D may be configured to execute various software applications, instructions, or computer code stored in a non-transitory computer-readable medium (e.g., the memory 112C or the storage 112E) causing the processor 112D to perform various operations. For example, a data link manager 112A may be stored as software, computer code, or instructions in the memory 112C and/or the storage 112E, and an edit synchronization manager 112B may be stored as software, computer code, or instructions in the memory 112C and/or the storage 112E. For example, execution of the data link manager 112A software by the processor 112D causes the processor to perform various data link management operations or to output instructions or signals to another device or component (such as the FMS 115, the display 114, or the communication system 111). For example, execution of the edit synchronization manager 112B software by the processor 112D causes the processor 112D to perform various synchronization operations or to output instructions or signals to another device or component (such as the FMS 115 or the display 114). While FIG. 3B shows the data link manager 112A and the edit synchronization manager 112B stored in memory 112C as software applications, any of various suitable software applications, programs, or computer code may be stored in a non-transitory computer-readable medium configured to be executed by the processor 112D for performing any of various operations or functions as disclosed throughout.

Figure 3C:
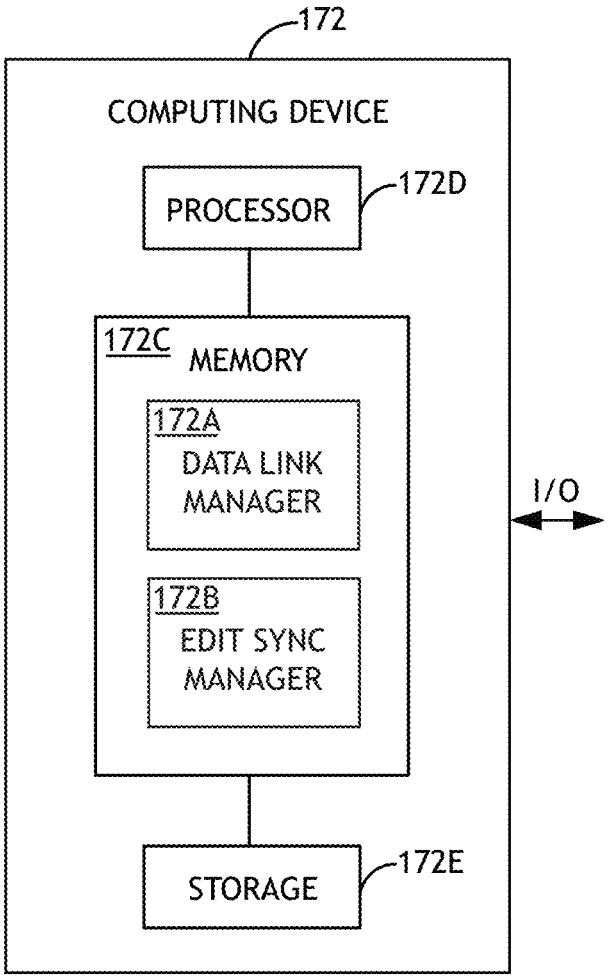
FIG. 3C depicts a computing device of an air control station of one embodiment.

Referring now to FIG. 3C, the computing device 172 of the air control station 170 of one embodiment is shown. The computing device 172 includes at least one processor 172D, memory 172C, and storage 172E, as well as other components, equipment, and/or devices commonly included in a computing device. The processor 172D, the memory 172C, and the storage 172E, as well as any other components may be communicatively coupled. The processor 172D may be configured to execute various software applications, instructions, or computer code stored in a non-transitory computer-readable medium (e.g., the memory 172C or the storage 172E) causing the processor 172D to perform various operations. For example, a data link manager 172A may be stored as software, computer code, or instructions in the memory 172C and/or the storage 172E, and an edit synchronization manager 172B may be stored as software, computer code, or instructions in the memory 172C and/or the storage 172E. For example, execution of the data link manager 172A software by the processor 172D causes the processor to perform various data link management operations or to output instructions or signals to another device or component (such as the FMS 175, the display 174, or the communication system 171). For example, execution of the edit synchronization manager 172B software by the processor 172D causes the processor 172D to perform various synchronization operations or to output instructions or signals to another device or component (such as the FMS 175 or the display 174). While FIG. 3C shows the data link manager 172A and the edit synchronization manager 172B stored in memory 172C, any of various suitable software applications, programs, or computer code may be stored in a non-transitory computer-readable medium configured to be executed by the processor 172D for performing any of various operations or functions as disclosed throughout.

Referring generally to FIGS. 2A-3C, the processor 133D of the computing device 133 of the ground control station 130, the processor 172D of the computing device 172 of the air control station 170, and the processor 112D of the computing device 112 of the RAV 110 are configured to manage data link communications (e.g., messages, commands, data, or the like) between or among the FMS 135 of the ground control station 130, the FMS 175 of the air control station 170, and the FMS 115 of the RAV 110. Data links between or among the communication system 131 of the ground control station 130, the communication system 171 of the air control station 170, and the communication system 111 of the RAV 110 may comprise radio frequency transmissions directly between two of the RAV 110, the air control station 170, and the ground control station 130 and/or communications indirectly routed through one or a combination of the ground control station 130, the air control station 170, the RAV 110, the satellites 141, the other aircraft 120, and/or the network 150.

In one embodiment, the processor 133D of the computing device 133 of the ground control station 130 is configured to perform data link management operations. For example, the processor 133D of the computing device 133 may receive data (e.g., FMS commands) from the FMS 135, and the processor 133D of the computing device 133 may instruct the communication system 131 to transmit the data to the RAV 110 and/or the air control station 170 over a particular wireless data link (e.g., a low latency data link or relatively higher latency data link). Additionally, the processor 133D of the computing device 133 may receive data (e.g., aircraft state data of the RAV 110 and/or the air control station 170, modified flight plan data, or FMS commands of the FMS 115 and/or the FMS 175) received by the communication system 131 from the FMS 115 of the RAV 110 and/or the FMS 175 of the air control station 170, and the processor 133D of the computing device 133 may forward the received data to the FMS 135 and/or the FMS 175 for synchronization.

In one embodiment, the processor 133D of the computing device 133 of the ground control station 130 is configured to manage bandwidth and latency for communications (e.g., transmitted data to the RAV 110 and received data from the RAV 110) over one or more data links between or among the RAV 110, the air control station 170, and/or the ground control station 130. For example, the processor 133D of the computing device 133 may be configured to reduce (e.g., minimize) bandwidth requirements and latency for transmissions of data to the RAV 110 by sending incrementally updated portions of FMS data to the RAV 110 while not sending unchanged portions of the FMS data to the RAV 110. The processor 133D of the computing device 133 may determine the incrementally updated portions of the FMS data by comparing new FMS data from the FMS 135 with most recent FMS data to identify the incrementally updated portions of the FMS data and the unchanged portions of the FMS data or by dynamically identifying only changes (e.g., edits) to the most recent FMS data. Sending the incrementally updated portions of the FMS data reduces the necessary bandwidth and reduces latency to send updated FMS data to the FMS 115 of the RAV 110 and/or the FMS 175 of the air control station 170. Sending the incrementally updated portions of the FMS data reduces bandwidth to better work within the environment of wireless networks. This has the potential to increase the availability of existing, certified systems functionality and make the system more readily and more economically feasible. Further, in one embodiment, the processor 133D is configured to direct the communication system 131 of the ground control station 130 to aim transmissions in a direction toward the RAV 110 or the air control station 170 based on received flight management system data and/or time-space-position information of the RAV 110 or the air control station 170.

In one embodiment, the processor 133D of the computing device 133 is configured to perform data integrity management operations for communications (e.g., transmitted data to the RAV 110 and/or the air control station 170 and received data from the RAV 110 and/or the air control station 170) over one or more data links between or among the RAV 110, the air control station 170, and/or the ground control station 130. For example, the processor 133D of the computing device 133 may perform quality of service operations on data received from the FMS 135 (or from other systems) of the ground control station 130 to prioritize data flows associated with particular types of data. For example, data flows associated with FMS data (e.g., an FMS command) may be prioritized over other data types. Performing quality of service operations allows high priority data flows to be timely transmitted over a limited bandwidth data link between or among the RAV 110, the air control station 170, and/or the ground control station 130 while allowing lower priority data flows to be throttled or delayed until necessary bandwidth is available.

Additionally, for example, the processor 133D of the computing device 133 may perform error detecting operations on data received from the RAV 110 and/or the air control station 170. Any suitable error detecting scheme may be used, such as cyclic redundancy checks (CRCs), parity bits, checksums, repetition codes, error-correcting codes, or the like. For example, the processor 133D of the computing device 133 may perform cyclic redundancy checks (CRCs) on data received from the FMS 115 of the RAV 110 to maintain synchronization. Performing CRCs on the received data allows the processor 133D to verify data and to detect any changes (e.g., errors caused by noise) to the received raw data from the RAV 110 or the air control station 170. Similarly, the processor 133D of the computing device 133 may encode the data messages that are to be transmitted to the RAV 110 or the air control station 170 by adding a fixed-length check value prior to the transmission of the data messages to the RAV 110 or the air control station 170; encoding the transmitted data messages allows the processor 112D of the computing device 112 of the RAV 110 and/or the processor 172D of the computing device 172 of the air control station 170 to perform CRCs on the data messages received at the RAV 110 or the air control station 170 to verify the data and detect errors.

Figure 9:
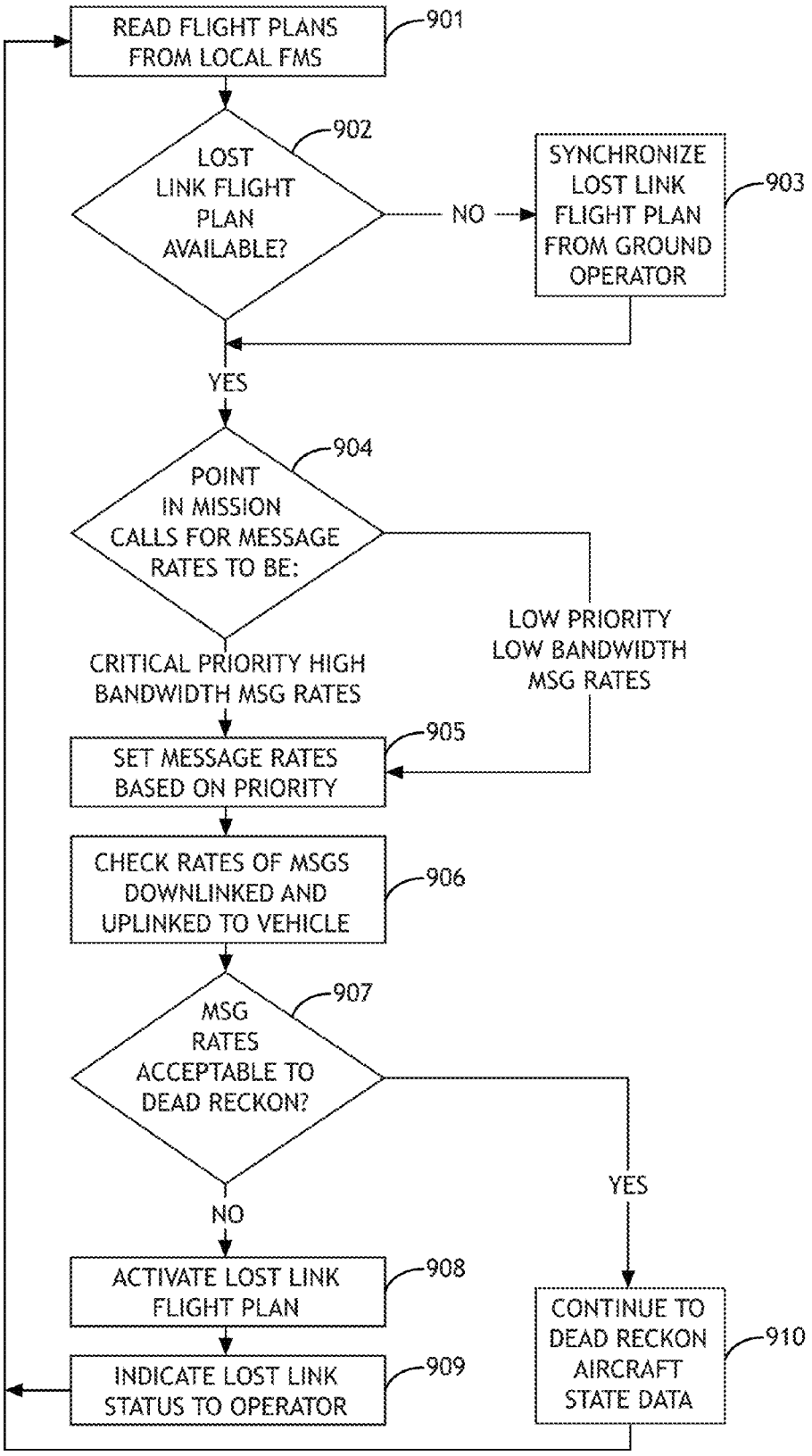
FIG. 9 depicts a method for prioritizing data transmission rate and flight plans and performing a position estimate process in a distributed flight management system of one embodiment.

Additionally, for example, the processor 133D may perform a CRC calculation on the current FMS data from the FMS 135 and receive a CRC calculation of FMS data received from the FMS 115 of the RAV 110 to determine if there is a CRC mismatch between FMS data of the FMS 135 and FMS data of the FMS 115 and to determine whether any CRC mismatch exceeds a predetermined threshold; if a CRC mismatch exceeds the predetermined threshold, FMS data of the FMS 135 is sent to the RAV 110 to be synchronized with the FMS data of the FMS 115 of the RAV 110, as is described in more detail with respect to FIG. 9. Further, for example, the processor 133D of the computing device 133 may perform error recovery operations to recover data or return data to a known state (e.g., a most recent known state) if, for example, packet loss occurs.

Similarly, in one embodiment, the processor 112D of the computing device 112 of the RAV 110 is configured to perform data link management operations. For example, the processor 112D of the computing device 112 may receive data (e.g., FMS commands, autopilot commands, flight plan data, aircraft position data, or the like) from the FMS 115 or the FMS 175, and the processor 112D of the computing device 112 of the RAV 110 may instruct the communication system 111 to transmit the data to the ground control station 130 and/or the air control station 170 over a particular wireless data link (e.g., a low latency data link or relatively higher latency data link). Additionally, the processor 112D of the computing device 112 of the RAV 110 may receive data (e.g., FMS commands of the FMS 135 or of the FMS 175) received by the communication system 111 from the FMS 135 of the ground control station 130 and/or the FMS 175 of the air control station 170, and the processor 112D of the computing device 112 of the RAV 110 may forward the received data to the FMS 115 for synchronization.

In one embodiment, the processor 112D of the computing device 112 of the RAV 110 is configured to manage bandwidth and latency for communications (e.g., transmitted data to the ground control station 130 and/or the air control station 170 and received data from the ground control station 130 and/or the air control station 170) over one or more data links between or among the RAV 110, the air control station 170, and/or the ground control station 130. For example, the processor 112D of the computing device 112 of the RAV 110 may be configured to reduce (e.g., minimize) bandwidth requirements and latency for transmissions of data to the ground control station 130 by sending incrementally updated portions of data to the ground control station 130 while not sending unchanged portions of the data to the ground control station 130. The processor 112D of the computing device 112 of the RAV 110 may determine the incrementally updated portions of the data by comparing new data from the FMS 115 with most recent data to identify the incrementally updated portions of the data and the unchanged portions of the FMS data or by dynamically identifying only changes (e.g., edits) to the most recent data. Sending the incrementally updated portions of the data reduces the necessary bandwidth and reduces latency to send updated data to the FMS 135 of the ground control station 130 and/or the FMS 175 of the air control station 170.

In one embodiment, the processor 112D of the computing device 112 of the RAV 110 is configured to perform data integrity management operations for communications (e.g., transmitted data to the ground control station 130 and/or the air control station 170 and received data from the ground control station 130 and/or the air control station 170) over one or more data links between or among the RAV 110, the air control station 170, and/or the ground control station 130. For example, the processor 112D of the computing device 112 may perform quality of service operations on data received from the FMS 115 (or from other systems) of the RAV 110 and/or the FMS 175 to prioritize data flows associated with particular types of data (e.g., FMS data, time-space-position information, engine information, or the like). For example, data flows associated with an FMS command may be prioritized over other data types. Performing quality of service operations allows high priority data flows to be timely transmitted over a limited bandwidth data link between or among the RAV 110, the air control station 170, and/or the ground control station 130 while allowing lower priority data flows to be throttled or delayed until necessary bandwidth is available.

Additionally, for example, the processor 112D of the computing device 112 may perform error detecting operations on data received from the ground control station 130 and/or the air control station 170. Any suitable error detecting scheme may be used, such as cyclic redundancy checks (CRCs), parity bits, checksums, repetition codes, error-correcting codes, or the like. For example, the processor 112D of the computing device 112 may perform cyclic redundancy checks (CRCs) on data received from the FMS 135 of the ground control station to maintain synchronization. Performing CRCs on the received data allows the processor 112D to verify data and to detect any changes (e.g., errors caused by noise) to the received raw data from the ground control station 130 and/or the air control station 170. Similarly, the processor 112D of the computing device 112 may encode the data messages that are to be transmitted to the ground control station 130 and/or the air control station 170 by adding a fixed-length check value prior to the transmission of the data messages to the ground station; encoding the transmitted data messages allows the processor 133D of the computing device 133 of the ground control station 130 and/or the processor 172D of the computing device 172 of the air control station 170 to perform CRCs on the data messages received at the ground control station 130 and/or the air control station 170 to verify the data and detect errors. Further, for example, the processor 112D of the computing device 112 may perform error recovery operations to recover data or return data to a known state (e.g., a most recent known state) if, for example, packet loss occurs.

Figure 4:
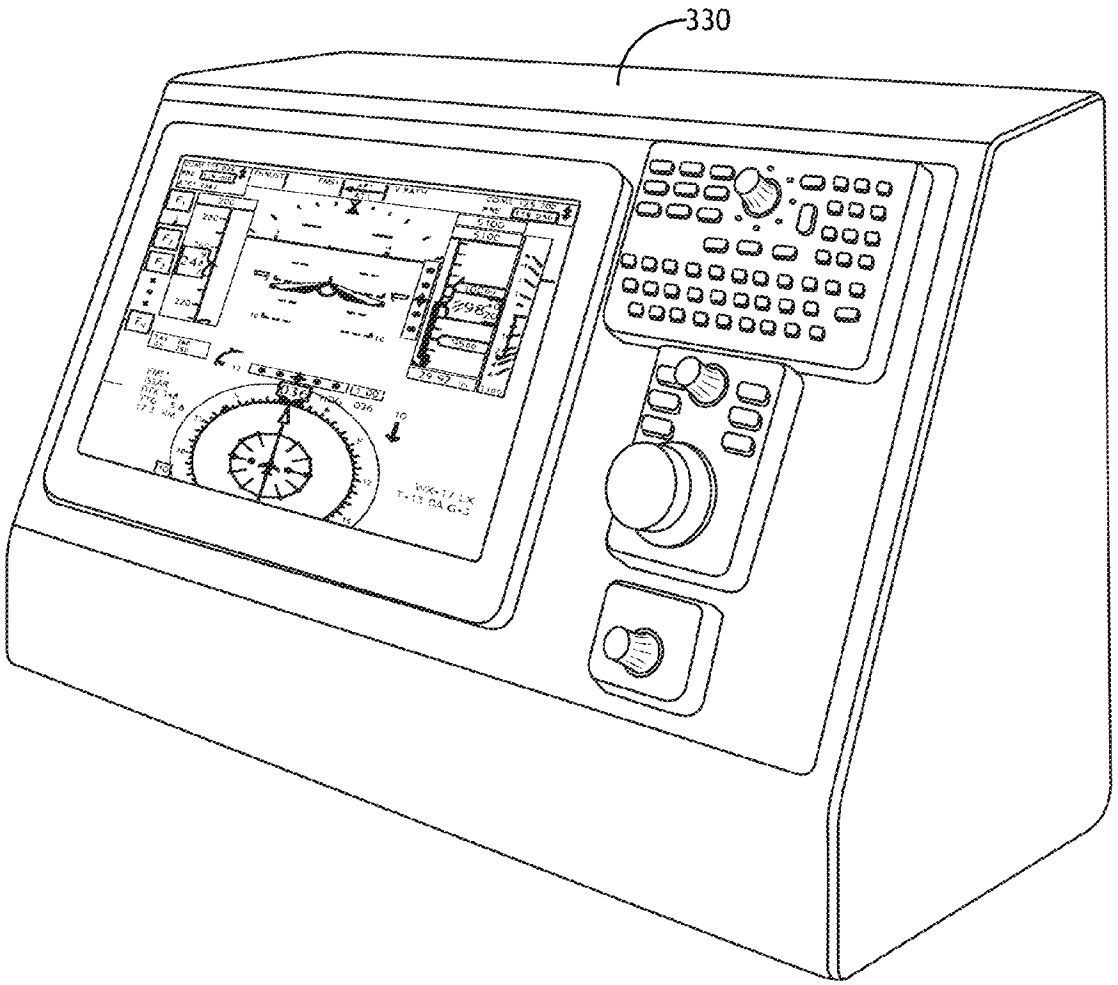
FIG. 4 depicts an adaptive flight display of a ground control station of one embodiment.

In some embodiments, the functionality of the FMS 135 and the computing device 133 may be implemented on a single computing device or on a plurality of computing devices. In some embodiments, the functionality of the FMS 115 and the computing device 112 may be implemented on a single computing device or on a plurality of computing devices. In some embodiments, the functionality of the FMS 175 and the computing device 172 may be implemented on a single computing device or on a plurality of computing devices. Further, while the FMS 135, the display 134, the computing device 133, and the communication system 131 are depicted as separate devices in FIGS. 1A-3B, in some embodiments the FMS 135, the display 134, the computing device 133, and the communication system 131 may be implemented as a single device (e.g., a single computing device) or on any number of devices (e.g., computing devices). For example, an integrated adaptive flight display (AFD) 330, as shown in FIG. 4, is configured to perform functionality analogous to and include components analogous to the FMS 135, the display 134, and the computing device 131 of the ground control station 130. Additionally, while the FMS 115, the display 114, the computing device 112, and the communication system 111 are depicted as separate devices in FIGS. 1A-3B, in some embodiments the FMS 115, the display 114, the computing device 112, and the communication system 111 may be implemented as a single device (e.g., a single computing device) or on any number of devices (e.g., computing devices). Further, while the FMS 175, the display 174, the computing device 172, and the communication system 171 are depicted as separate devices in FIGS. 1A-3C, in some embodiments the FMS 175, the display 174, the computing device 172, and the communication system 171 may be implemented as a single device (e.g., a single computing device) or on any number of devices (e.g., computing devices).

Figure 5:
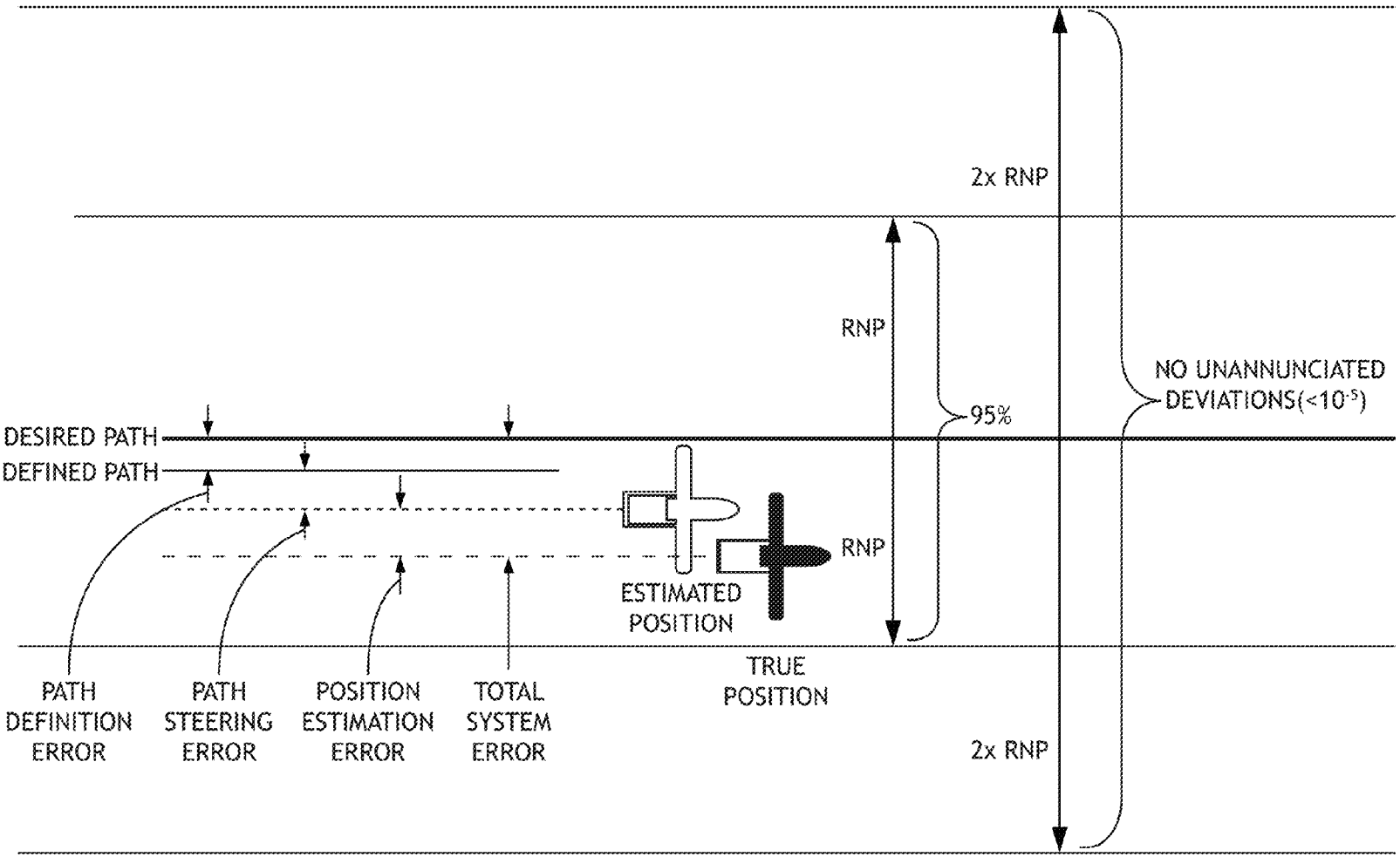
FIG. 5 depicts a diagram illustrating an exemplary required navigation performance (RNP)

Referring now to FIG. 5, a diagram illustrating an exemplary required navigation performance (RNP) is depicted. Required navigation performance (RNP) is a standard flight characteristic used for determining the allowable position error for an aircraft in flight. FIG. 5 shows an RNP corridor for the allowed position of the aircraft in relation to a desired path. The diagram illustrated in FIG. 5 shows a desired path and a defined path. A path definition error is the distance between the desired path and the defined path. The diagram illustrated in FIG. 5 also shows an estimated position of the aircraft and a true position of the aircraft. The estimated position is a position estimated based on data received from navigation sensors 118 and/or a GPS device 113 of the RAV 110 and/or navigation sensors 178 and/or a GPS device 173 of the air control station 170. The true position is the actual position of the aircraft. A path steering error is a distance between the defined path and the estimated position of the aircraft. A position estimate error is a distance between the actual true position and an estimated position of the aircraft. The total system error is the sum of the path definition error, the path steering error, and the position estimate error; the total system error is also equal to a distance from the true position of the aircraft to the desired path. The RNP corridor represents the required accuracy for the true position of the aircraft in relation to the desired path.

Typically, it is required that the total system error remains equal to or better than the required accuracy for 95% of the flight time, and typically, it is required that the probability that the total system error of an aircraft exceeds the specified total system error limit (equal to two times the required accuracy value (e.g., for the RNP)) without annunciation is less than $10^{-5}$. In some embodiments, RNP information is utilized by the computing device 112, the computing device 133, the computing device 172, the FMS 115, the FMS 175, and/or the FMS 135 for determining an acceptable synchronization error for use in managing data links and synchronizing a distributed FMS system. Additionally, in some embodiments, RNP information is utilized by the computing device 112, the computing device 133, the computing device 172, the FMS 115, the FMS 175, and/or the FMS 135 for scheduling the exchange of data between or among a distributed FMS system.

Figure 7:
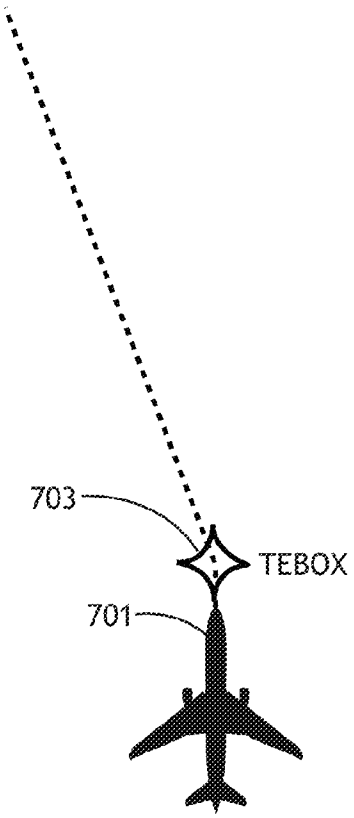
FIG. 7 depicts a flight management system map graphic at a second point in time.
Figure 6:
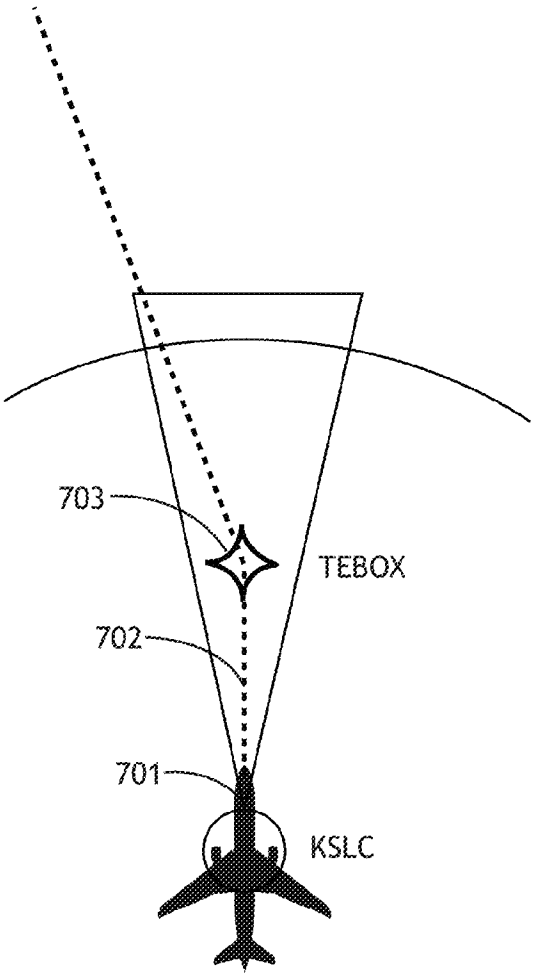
FIG. 6 depicts a flight management system map graphic at a first point in time.

Referring now to FIGS. 6-7, portions of an FMS map graphic at different points in time are depicted. Flight plans include legs (e.g., leg 702) and terminators (e.g., waypoint 703). FIG. 6 shows a first position of an aircraft 701 traveling along leg 702 toward waypoint 703. FIG. 7 shows a second position of the aircraft 701 traveling along the leg 702 toward the waypoint 703. As shown in FIG. 7, the second position of the aircraft 701 is much closer to the waypoint 703 than the first position as shown in FIG. 6. In some embodiments, a distance of an aircraft to a next terminator of a flight plan is utilized by the computing device 112, the computing device 113, the computing device 172, the FMS 115, the FMS 175, and/or the FMS 135 for determining an acceptable synchronization error for use in managing data links and synchronizing a distributed FMS system. Additionally, in some embodiments, a distance of an aircraft to a next terminator of a flight plan is utilized by the computing device 112, the computing device 113, the computing device 172, the FMS 115, the FMS 175, and/or the FMS 135 for scheduling the exchange of data between or among a distributed FMS system.

Referring again, generally to FIGS. 2A-3C and FIGS. 5-7, in one embodiment, the processor 112D of the computing device 112 of the RAV 110 is configured to schedule transmission of data (e.g., data flows) of different data types to the ground control station 130 and/or the air control station 170 based on a priority scheme and/or to recover data from lost packets by utilizing a priority scheme. In one embodiment, the processor 112D of the computing device 112 is configured to dynamically schedule transmission of data (e.g., data flows) of different data types to the ground control station 130 and/or the air control station 170. In one embodiment, the processor 112D of the computing device 112 is configured to dynamically schedule transmission of data (e.g., data flows) of different data types to the ground control station 130 and/or the air control station 170 based on one or more parameters associated with the RAV 110. For example, the one or more parameters associated with the RAV 110 may include a required accuracy associated with an RNP (such as the width of the RNP corridor) and/or a distance to a transition (e.g., a next transition or a subsequent selected terminator) of a flight plan from a current position of the RAV 110. That is, for example, the processor 112D of the computing device 112 may dynamically change (e.g., dynamically reassign) priority levels of different data types for use in scheduling the transmission of data of the data types to the ground control station 130 and/or the air control station 170 based on RNP information and/or the distance to a transition of the flight plan.

Further, for example, if the required accuracy associated with the RNP decreases (or is relatively low), the processor 112D of the computing device 112 may increase priority of FMS data and decrease priority of aircraft monitoring data (such as aircraft state data, such as time-space-position information). On the other hand, for example, if the required accuracy associated with the RNP increases (or is relatively high), the processor 112D of the computing device 112 may decrease priority of FMS data and increase priority of aircraft monitoring data (such as aircraft state data). In some embodiments, by dynamically changing the priority for different data types (e.g., FMS data, aircraft state data, or the like) based on aircraft parameters, the processor 112D is able to schedule data transmissions from the RAV 110 to the ground control station 130 and/or the air control station 170 despite constraints of limited bandwidth and possibility of data loss (e.g., caused by lost packets) while maintaining acceptable on-time delivery.

Figure 8:
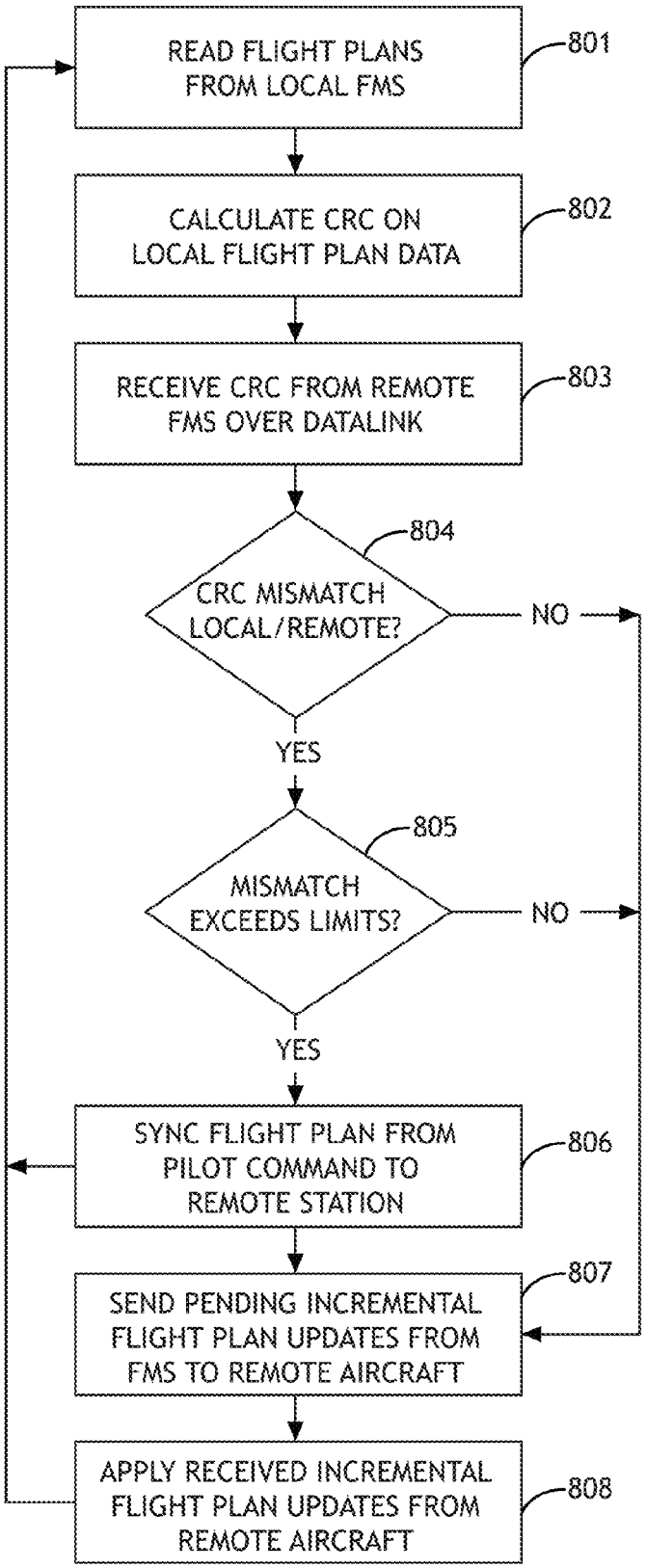
FIG. 8 depicts a method for incrementally updating a flight plan in a distributed flight management system of one embodiment.

Referring now to FIG. 8, a method for incrementally updating a flight plan in a distributed FMS system of one embodiment is shown. It is contemplated that the method of FIG. 8 can be performed by the computing device 133; the FMS 135; at least one component, circuit, controller, or module of computing device 133 and/or the FMS 135; the processor 135A of the FMS 135; the processor 133D of the computing device 133; the computing device 172; the FMS 175; at least one component, circuit, controller, or module of computing device 172 and/or the FMS 175; the processor 175A of the FMS 175; the processor 172D of the computing device 172; and/or other computing devices or components of the system topology 100. The method of FIG. 8 can include any or all of steps 801, 802, 803, 804, 805, 806, 807, and/or 808, and it is contemplated that the method of FIG. 8 can include additional steps as disclosed throughout, but not explicitly set forth in this paragraph. Further, it is fully contemplated that the steps of the method of FIG. 8 can be performed concurrently or in a non-sequential order. Likewise, it is fully contemplated that the method of FIG. 8 can be performed prior to, concurrently, subsequent to, or in combination with the performance of one or more steps of one or more other operations, functionality, or methods disclosed throughout.

The method depicted in FIG. 8 may include a step 801 of reading flight plans (e.g., FMS data) from a local FMS (e.g., the FMS 135 of the ground control station 130 or the FMS 175 of the air control station 170). The method may include a step 802 of calculating a cyclic redundancy check (CRC) of the read local flight plan data. The method may include a step 803 of receiving a calculated CRC from a remote FMS (e.g., FMS 115 of the RAV 110) transmitted over a datalink. The method may include a step 804 of determining whether there is a CRC mismatch between the CRC of the local FMS (e.g., FMS 135 or FMS 175) and the CRC from the remote FMS (e.g., FMS 115). If there is a CRC mismatch between the CRC of the local FMS (e.g., FMS 135 or FMS 175) and the CRC from the remote FMS (e.g., FMS 115), the method may include a step 805 of determining whether the CRC mismatch exceeds a threshold (e.g., predetermined limits). If the CRC mismatch exceeds the predetermined threshold, the method may include a step 806 of synchronizing the flight plan, which may for example include a pilot command, with the remote FMS (e.g., FMS 115 of the RAV 110).

The method may include a step 807 of sending one or more pending incremental flight plan updates of the local FMS (e.g., FMS 135 or FMS 175) to the remote aircraft (e.g., RAV 110). Additionally, the step 807 may be performed if there is not a CRC mismatch between the CRC of the local FMS (e.g., FMS 135 or FMS 175) and the CRC from the remote FMS (e.g., FMS 115) as determined in step 804 or if the CRC mismatch does not exceed a predetermined threshold as determined in step 805. The method may include a step 808 of applying received incremental flight plan updates from the remote aircraft (e.g., RAV 110). The method described with respect to and depicted in FIG. 8 may be performed as a plurality of repeated iterations of operations.

Referring again, generally to FIGS. 2A-3C, as well as FIG. 9, some embodiments are configured to determine (e.g., identify) the occurrence of a lost data link between or among the ground control station 130, the air control station 170, and/or the RAV 110, configured to determine when and how to reestablish the data link connection, and configured to reestablish the data link connection. Lost data links may include ground lost links, air lost links, ground and air lost links, and air-to-air lost data links. For example, upon the occurrence of a ground lost link, a ground control station 130 is not able to send flight plan modifications to an RAV 110, but the ground control station 130 is still able to receive position and flight plan modifications from the RAV 110. For air lost links, the RAV 110 is not able to send flight plan modifications or time-space-position-information (TSPI) to a ground control station 130, but the RAV 100 is still able to receive flight plan modifications from the ground control station 130. For ground and air lost links, both of the RAV 110 and the ground control station 130 are not able to communicate flight plan modifications or position information between each other. For example, for air-to-air lost data links, the RAV 110 and the air control station 170 are not able to communicate flight plan modifications or position information in at least one direction (e.g., RAV 110 to air control station 170 or air control station 170 to RAV 110) between each other.

For example, one embodiment includes determining (e.g., by the processor 133D, the FMS 135, the processor 172D, the FMS 175, the processor 112D, and/or the FMS 115) the occurrence of a lost data link or weakened data link and identifying the type of a lost data link (e.g., ground lost links, air lost links, ground and air lost links, or air-to-air lost links) or a weakened data link. One embodiment includes determining (e.g., by the processor 133D, the FMS 135, the processor 172D, the FMS 175, the processor 112D, and/or the FMS 115) an operation (e.g., adjusting data flow transmission rates or adjusting a position estimation process) to perform based on mission parameters (e.g., whether the RAV 110 is in an approach, cruising, taking off, or flying search and rescue patterns) upon the occurrence of the lost data link or the weakened data link. Different mission parameters may have different priorities and different associated attributes. For example, a landing mission parameter may have a higher priority for time-space-position information than engine information. Additionally, for example, a landing mission parameter has a typical data link signal strength that is lower than a typical data link signal strength associated with a cruise mission parameter because during landing signal strength is typically less than during cruising. As such, for example, the determined operation to perform based on landing mission parameter may be to increase data transmission rates of time-space-position information and to reduce data transmission rates of engine information during landing. Different parameters may result in different determined operations to perform. Additionally, one embodiment includes performing the determined operation.

In one embodiment, performing the determined operation includes modifying (e.g., by the processor 112D of the RAV 110) data transmission rates for different data types (e.g., time-space-position information (TSPI), engine information, etc.) of remaining available bandwidth (of the weakened air data link or another available air data link) for transmissions to the ground control station 130 and/or the air control station 170. Modifying data transmission rates may include utilizing a priority scheme based on assigned (or dynamically reassigned) priority levels to different data types. For example, modifying data transmission rates may include reducing data transmission rates of time-space-position information to less than data transmission rates of engine information or increasing data transmission rates of time-space-position information to be more than data transmission rates of engine information.

Additionally, in one embodiment, performing the determined operation includes initiating or adjusting (e.g., by the processor 133D or the FMS 135 of the ground control station 130 or by the processor 172D or the FMS 175 of the air control station 170) a position estimation (e.g., dead reckoning) process. For example, initiating a position estimation process may include initiating a dead reckoning process to estimate future positions of the RAV 110 based on known previous positions and speeds. Dead reckoning (also referred to as deduced reckoning) is a method of predicting where the aircraft is or will be based on previous information. Adjusting a position estimation process may include changing (e.g. increasing or decreasing) an amount of time (beyond last known time-space-position information) for which the position estimation process is predicting future positions of the RAV 110 based on the rate of received time-space-position information from the RAV 110. For example, if the processor 133D or the FMS 135 of the ground control station 130 receives a lack of or infrequent time-space-position information, the processor 133D or the FMS 135 may increase the amount of time into the future that position estimation process (e.g., dead reckoning) is predicting, and the position estimation process may iteratively incorporate verified time-space-position information into predicted positions each time time-space-position information is received from the RAV 110.

One embodiment includes determining (e.g., by the processor 133D, the processor 172D, or the processor 112D) a time to reestablish a data link based on link stability or strength, and reestablishing the datalink at the determined time.

Additionally, in one embodiment, the display 134 of the ground control station 130 and/or the display 174 of the air control station 170 is configured to receive graphical data link status data (for example, from the FMS 135 or the computing device 133 or from the FMS 175 or the computing device 172) based on context of a mission parameter and graphically present, to a user, link status information (e.g., data link strength or stability, whether a data link is connected or lost, packet transmission reliability, estimated time to expected data link loss event, estimated time to reconnection of data link, and/or the like) associated with one or more data links.

Similarly, in embodiments where the RAV 110 includes a display 114, the display 114 of the RAV 110 may be configured to receive graphical data link status data (for example, from the FMS 115 or the computing device 112) based on context of a mission parameter and graphically present, to a pilot, link status information (e.g., data link strength or stability, whether a data link is connected or lost, packet transmission reliability, estimated time to expected data link loss event, estimated time to reconnection of data link, and/or the like) associated with one or more data links.

Referring now to FIG. 9, a method for managing data transmission rate and flight plans and performing a position estimate process in a distributed FMS system of one embodiment is shown. It is contemplated that the method of FIG. 9 can be performed by the computing device 133; the FMS 135; at least one component, circuit, controller, or module of computing device 133 and/or the FMS 135; the processor 135A of the FMS 135; the processor 133D of the computing device 133; the computing device 172; the FMS 175; at least one component, circuit, controller, or module of computing device 172 and/or the FMS 175; the processor 175A of the FMS 175; the processor 172D of the computing device 172; and/or other computing devices or components of the system topology 100. The method of FIG. 9 can include any or all of steps 901, 902, 903, 904, 905, 906, 907, 908, 909, and/or 910 and it is contemplated that the method of FIG. 9 can include additional steps as disclosed throughout, but not explicitly set forth in this paragraph. Further, it is fully contemplated that the steps of the method of FIG. 9 can be performed concurrently or in a non-sequential order. Likewise, it is fully contemplated that the method of FIG. 9 can be performed prior to, concurrently, subsequent to, or in combination with the performance of one or more steps of one or more other operations, functionality, or methods disclosed throughout.

The method depicted in FIG. 9 may include a step 901 of reading (e.g., by processor 133D) flight plans (e.g., FMS data) from a local FMS (e.g., FMS 135 of the ground control station 130 or FMS 175 of the air control station 170). The method may include a step 902 of determining (e.g., by processor 133D, processor 135A, processor 172D, or processor 175A) whether a lost link flight plan is available. A lost link flight plan is a flight plan for the RAV 110 to follow if the ground control station 130 and/or the air control station 170 is not able to receive time-space-position information from the RAV 110 at an acceptable data transmission rate for performing a position estimate process (e.g., dead reckoning) or if an air lost link or air-to-air lost link occurs. The lost link flight plan may be updated during flight by the computing device 133 or the FMS 135 of the ground control station 130 or by the computing device 172 or the FMS 175 of the air control station 170 and may be synchronized with the FMS 115 of the RAV 110 so that the FMS 135 of the ground control station 130 and/or the FMS 175 of the air control station 170 and the FMS 115 of the RAV 110 have a synchronized lost link flight plan for the RAV 110 if the ground control station 130 and/or the air control station 170 do not receive time-space-position information from the RAV 110 at an acceptable data transmission rate for performing the position estimate process. If a lost link flight plan is not available, the method may include a step 903 of synchronizing a lost link flight plan from the ground control station 130 and/or the air control station 170 with the RAV 110 by sending the lost link from the ground control station 130 and/or the air control station 170 to the RAV 110.

The method may include a step 904 of determining a priority for data transmission rates (e.g., message rates) based on mission parameters (e.g., a location of a where the RAV 110 is in the mission, such as takeoff, landing, cruising, etc.). If it is determined based on the mission parameters that the data transmission rates have a high priority (e.g., critical priority), the data transmissions are allocated a high bandwidth data transmission rate. If it is determined based on the mission parameters that the data transmission rates have a low priority, the data transmissions are allocated a low bandwidth data transmission rate. Likewise, the method may include a step 905 of setting data rates (e.g., message rates) based on a determined priority. The method may include a step 906 of checking (e.g., measuring or determining) rates of data (e.g., messages) downlinked from and uplinked to the vehicle (e.g., RAV 110).

The method may include a step 907 of determining whether the data rates (e.g., message rates of time-space-position information) are acceptable to perform a position estimate process (e.g., dead reckoning). If the data rates are acceptable for performing a position estimate process (e.g., dead reckoning), the method may include a step 910 of continuing to perform a position estimate process to estimate aircraft state data (e.g., continue to dead reckon aircraft state data). If the data rates are unacceptable for performing a position estimate process (e.g., dead reckoning), the method may include a step 908 of activating the lost link flight plan. If the lost link flight plan is activated, the method may include a step 909 of indicating a lost link status to an operator at the ground control station 130 and/or the air control station 170 by outputting data to the display 134 and/or the display 174 to present the lost link status to the operator. The method described with respect to and depicted in FIG. 9 may be performed as a plurality of repeated iterations of operations.

Some embodiments include a distributed flight management system to provide an unmanned aerial system (UAS) access to fly in national airspace. Some embodiments provide a hardware and software solution for meeting national airspace requirements for UASs. Some embodiments are configured to utilize a reliable software architecture that is deterministic and provides criticality separation. Some embodiments are configured to meet operation performance requirements in airspace including accuracy (e.g., required accuracy associated with required navigation performance (RNP) such that lateral steering is within a distance of RNP (e.g., a predetermined number of nautical miles) 95% of the time), containment integrity (e.g., where the probability that the total system error is larger than containment area (two times the RNP) with alerting the crew is less than $10^{-5}$ per hour), and containment continuity (e.g., probability of loss of RNP area navigation (RNAV) capability is less than $10^{-4}$ per hour).

Embodiments implemented with a distributed flight management system including an FMS (e.g., FMS 135 and/or FMS 175) of a control station (e.g., ground control station 130 and/or air control station 170) and an FMS 115 of a UAS allow for the planning of a multi-step mission. Embodiments including a UAS implemented with an FMS 115 are configured to determine a required fuel for a UAS to complete a mission within a margin of safety or margin of error. Embodiments including a UAS implemented with an FMS 115 are configured to provide precise arrival times for rendezvous or other coordination. Embodiments including a UAS implemented with an FMS 115 are configured to provide situational awareness and management of flight in real time. Embodiments including a UAS implemented with an FMS 115 are configured to account for weather, air traffic, restricted airspace, notices to airmen (NOTAMs), and/or threats. Embodiments including a UAS implemented with an FMS 115 are configured to improve efficiency to reduce operating costs by, for example, reducing a necessary number of crewmembers and by improving fuel efficiency (such as by utilizing an improved or optimal climb rate, altitude, speed, and/or descent).

Embodiments including a UAS implemented with an FMS 115 are configured to allow a UAS to access preferred or controlled routes by achieving required RNP containment capabilities, accessing databased procedures with assigned RNP values, avoiding delays and reroutes due to denials. Embodiments including a UAS implemented with an FMS 115 are interoperable with other aircraft 120 in civil airspace, for example, by sharing intent data for real-time deconfliction with other aircraft 120. Embodiments including a UAS implemented with an FMS 115 provide a beneficial user experience by providing a familiar interface, look, and feel for aviation personnel. Embodiments including a UAS implemented with an FMS 115 provide UASs with access to commercially available flight planning software, which may include features for map products, weather reports, charts, checklists, or the like.

While in one embodiment the processor 133D of the computing device 133 of the ground control station 130 has been described as configured to perform various operations described throughout, in some embodiments, the processor 135A of the FMS 135 is configured to perform some or all of such operations. Additionally, while in one embodiment the processor 112D of the computing device 112 of the RAV 110 has been described as configured to perform various operations described throughout, in some embodiments, the processor 115A of the FMS 115 is configured to perform some or all of such operations. Further, while in one embodiment the processor 172D of the computing device 172 of the air control station 170 has been described as configured to perform various operations described throughout, in some embodiments, the processor 175A of the FMS 175 is configured to perform some or all of such operations.

As used throughout, "at least one" means one or a plurality of; for example, "at least one" may comprise one, two, three, . . . , one hundred, or more. Similarly, as used throughout, "one or more" means one or a plurality of; for example, "one or more" may comprise one, two, three, . . . , one hundred, or more.

In the present disclosure, the methods, operations, and/or functionality disclosed may be implemented as sets of instructions or software readable by a device. Further, it is understood that the specific order or hierarchy of steps in the methods, operations, and/or functionality disclosed are examples of exemplary approaches. Based upon design preferences, it is understood that the specific order or hierarchy of steps in the methods, operations, and/or functionality can be rearranged while remaining within the disclosed subject matter. The accompanying claims may present elements of the various steps in a sample order, and are not necessarily meant to be limited to the specific order or hierarchy presented.

It is believed that embodiments of the present disclosure and many of its attendant advantages will be understood by the foregoing description, and it will be apparent that various changes can be made in the form, construction, and arrangement of the components thereof without departing from the scope of the disclosure or without sacrificing all of its material advantages. The form herein before described being merely an explanatory embodiment thereof, it is the intention of the following claims to encompass and include such changes.

What is claimed is:

1. A distributed flight management system, comprising:
a control station, including:
a communication system configured to exchange data with a remotely accessed vehicle; and
at least one processor configured to:
operate a control station instance of the distributed flight management system;
receive flight management system data from the remotely accessed vehicle;
receive time-space-position information of the remotely accessed vehicle from the remotely accessed vehicle;
update the control station instance of the distributed flight management system based at least on the received flight management system data and the time-space-position information of the remotely accessed vehicle; and
output updated flight management system data for transmission to the remotely accessed vehicle to synchronize a remotely accessed vehicle instance of the distributed flight management system with the control station instance of the distributed flight management system.

2. The system of claim 1, wherein the control station is an air control station.

3. The system of claim 1, wherein the control station is a ground control station.

4. The system of claim 1, wherein only a portion of the remotely accessed vehicle instance of the distributed flight management system is synchronized with the control station instance of the distributed flight management system.

5. The system of claim 1, further comprising:
the remotely accessed vehicle, including:
a communication system configured to exchange data with the control station; and
at least one processor configured to:
operate the remotely accessed vehicle instance of the distributed flight management system;
receive flight management system data from the control station;
update the remotely accessed vehicle instance of the distributed flight management system based at least on the received flight management system data from the control station; and
output updated flight management system data and time-space-position information for transmission to the control station.

6. The system of claim 5, wherein the remotely accessed vehicle is an unmanned aerial system.

7. The system of claim 5, wherein the remotely accessed vehicle is configured to accommodate one or more onboard pilots.

8. The system of claim 5, wherein the at least one processor of the remotely accessed vehicle is further configured to prioritize a transmission of data of a first data type over a transmission of data of a second data type based on one or more parameters.

9. The system of claim 8, wherein the at least one processor of the remotely accessed vehicle is further configured to prioritize a transmission of data of a first data type over a transmission of data of a second data type based on at least one of a required navigation performance, a distance between a position of the remotely accessed vehicle and a flight transition, or a mission parameter, wherein the at least one processor of the remotely accessed vehicle is further configured to dynamically adjust at least one priority level of at least one data type.

10. The system of claim 1, wherein the at least one processor of the control station is further configured to output incrementally updated portions of the flight management system data for transmission to the remotely accessed vehicle to synchronize the remotely accessed vehicle instance of the distributed flight management system with the control station instance of the distributed flight management system.

11. The system of claim 1, wherein the at least one processor of the control station is further configured to receive incrementally updated portions of the flight management system data from the remotely accessed vehicle.

12. The system of claim 1, wherein the at least one processor of the control station is further configured to:
prioritize a transmission of data of a first data type over a transmission of data of a second data type based on at least one of a required navigation performance, a distance between a position of the remotely accessed vehicle and a flight transition, or a mission parameter; and dynamically adjust at least one priority level of at least one data type.

13. The system of claim 1, wherein the at least one processor of the control station is further configured to perform at least one error detecting operation on the flight management system data or the time-space-position information received from the remotely accessed vehicle.

14. The system of claim 1, wherein the at least one processor of the control station is further configured to:

calculate a cyclic redundancy check;

receive a cyclic redundancy check calculation form the remotely accessed vehicle;

identify a cyclic redundancy check mismatch; and perform at least one operation upon identification of the cyclic redundancy check mismatch.

15. The system of claim 1, wherein the at least one processor of the control station is further configured to determine an acceptable synchronization error between the remotely accessed vehicle instance of the distributed flight management system and the control station instance of the distributed flight management system based on at least one of a required navigation performance or a distance between a position of the remotely accessed vehicle and a flight transition.

16. The system of claim 1, wherein the at least one processor of the control station is further configured to:

determine an occurrence of a lost data link or a weakened data link; and perform at least one operation in response to a determination of the occurrence of the lost data link or the weakened data link.

17. The system of claim 1, wherein the at least one processor of the control station is further configured to perform a position estimation process.

18. The system of claim 1, wherein the at least one processor of the control station is further configured to output link status information to a display for presentation to a user.

19. A method of operating a distributed flight management system, comprising:

operating a control station instance of a distributed flight management system;

receiving flight management system data from a remotely accessed vehicle;

receiving time-space-position information of the remotely accessed vehicle from the remotely accessed vehicle;

updating the control station instance of the distributed flight management system based at least on the received flight management system data and the time-space-position information of the remotely accessed vehicle; and outputting updated flight management system data for transmission to the remotely accessed vehicle to synchronize a remotely accessed vehicle instance of the distributed flight management system with the control station instance of the distributed flight management system.

20. A method of operating a distributed flight management system, comprising:

operating a remotely accessed vehicle instance of a distributed flight management system;

receiving flight management system data from a control station;

updating the remotely accessed vehicle instance of the distributed flight management system based at least on the received flight management system data from the control station; and outputting updated flight management system data and time-space-position information for transmission to the control station to synchronize the remotely accessed vehicle instance of the distributed flight management system with a control station instance of the distributed flight management system.

* * * * *